US007172544B2

(12) United States Patent
Ki et al.

(10) Patent No.: US 7,172,544 B2
(45) Date of Patent: Feb. 6, 2007

(54) CONDUCTIVE ROLLER AND IMAGE-FORMING APPARATUS HAVING CONDUCTIVE ROLLER

(75) Inventors: Yogun Ki, Hyogo (JP); Takayuki Hattori, Hyogo (JP); Kiyotaka Okuda, Hyogo (JP); Kenichi Uesaka, Hyogo (JP)

(73) Assignee: Sumitomo Rubber Industries, Ltd., Kobi (JP)

( * ) Notice: Subject to any disclaimer, the term of this patent is extended or adjusted under 35 U.S.C. 154(b) by 522 days.

(21) Appl. No.: 10/705,950

(22) Filed: Nov. 13, 2003

(65) Prior Publication Data

US 2004/0096247 A1 May 20, 2004

(30) Foreign Application Priority Data

Nov. 15, 2002 (JP) ..... 2002-332342
Nov. 21, 2002 (JP) ..... 2002-338512
May 29, 2003 (JP) ..... 2003-152647

(51) Int. Cl.
*B25F 5/02* (2006.01)

(52) U.S. Cl. ..... 492/56; 492/53

(58) Field of Classification Search ..... 492/56; 399/286
See application file for complete search history.

(56) References Cited

U.S. PATENT DOCUMENTS

| | | | | |
|---|---|---|---|---|
| 6,067,434 | A | 5/2000 | Takagi et al. | 399/286 |
| 6,697,587 | B2 | 2/2004 | Harada | 399/111 |
| 2003/0236330 | A1 | 12/2003 | Hattori et al. | 524/155 |
| 2004/0106708 | A1 | 6/2004 | Mizumoto et al. | 524/242 |
| 2006/0074162 | A1 | 4/2006 | Mizumoto et al. | 524/401 |

FOREIGN PATENT DOCUMENTS

| | | | |
|---|---|---|---|
| JP | 08-334995 | A | 12/1996 |
| JP | 10-254215 | A | 9/1998 |
| JP | 2001-175098 | A | 6/2001 |
| JP | 2002-020537 | A | 1/2002 |
| JP | 2002-296930 | A | 10/2002 |

*Primary Examiner*—Marc Jimenez
(74) *Attorney, Agent, or Firm*—Birch, Stewart, Kolasch & Birch, LLP

(57) ABSTRACT

A conductive roller including at least one conductive elastic layer 1 formed of a polymer composition includes a main-component polymer not containing chlorine nor bromine and containing polyether or/and a cyan group; and an anion-containing salt having a fluoro group and a sulfonyl group. The anion-containing salt having the fluoro group and the sulfonyl group includes at least one salt selected from among a salt of bisfluoroalkylsulfonylimide, a salt of fluoroalkylsulfonic acid, and a salt of tris(fluoroalkylsulfonyl) methide.

14 Claims, 4 Drawing Sheets

CONDUCTIVE ROLLER AND IMAGE-FORMING APPARATUS HAVING CONDUCTIVE ROLLER

This Nonprovisional application claims priority under 35 U.S.C § 119(a) on Patent Application No(s). 2002-332342, 2002-338512 and 2003-152647 filed in Japan on Nov. 15, 2002, Nov. 21, 2002% and May 29, 2003, respectively, the entire contents of which are hereby incorporated by reference.

BACKGROUND OF THE INVENTION

Field of the Invention

The present invention relates to a conductive roller and an image-forming apparatus having the conductive roller. More particularly, the present invention is intended to allow the electric resistance of a conductive roller for use in image-forming apparatuses such as a copying machine, a laser beam printer, a facsimile, an ATM, and the like to have a low degree of dependence on environment, small variations with time, and a low degree of fluctuation independent of positions of the conductive roller to thereby form an image preferably and reliably.

Conductive rollers such as a charging roller, a developing roller, a transfer roller, a toner supply roller are used for image-forming apparatuses such as a printer, an electrophotographic copying apparatus, a facsimile apparatus, and the like. In forming an image by the image-forming apparatus, initially, the charging roller uniformly charges a member such as a photosensitive member which holds an electrostatic latent image. Then the electrostatic latent image is formed on the photosensitive member by performing an image exposure. Thereafter the developing roller supplies toner to the photosensitive member to form a toner image. The toner image is transferred to paper or the like through the transfer roller and fixed thereto. In this manner, a desired image is printed.

The conductive roller is demanded to have various performances, for example, favorable electrical conduction such as an electric resistance, a low hardness, a low compression set to obtain dimensional stability, and the like. The transfer roller is used to transfer the electrostatic latent image formed on the photosensitive member to paper. Thus the transfer roller is particularly demanded to have the above-described performances.

In the conductive roller of this kind, according to a known method, a conduction-imparting agent such as carbon black or a metal oxide is kneaded into rubber and dispersed therein to thereby control the electric resistance of the conductive roller. However, this method has difficulty in controlling the dispersion of the conduction-imparting agent. Further this method has another problem that the dispersion state of the conduction-imparting agent changes owing to the flow of the rubber during molding and vulcanization. The electric resistance value of the carbon black changes abruptly in a region owing to a slight change of an addition amount thereof to the rubber. Thus it is very difficult to control the electric resistance of the conductive roller by using the carbon black.

To impart electric conduction to the roller, it is conceivable to use a conductive oligomer (Mn is not more than 10000) such as polyethylene oxide containing the polyether structure and a conductive plasticizer (Mn is less than 10000). However, these substances may stain a photosensitive member because they are apt to bleed. It is also conceivable to control the electric resistance of the conductive roller by adding a quaternary ammonium salt having a high dissociation degree to its rubber component. The anions of the quaternary ammonium salt are often ions of perchloric acid or ions of chloride. These ions are liable to make the rubber composition to deteriorate in its mechanical characteristics. Particularly the compression set is greatly deteriorated. Thus it is difficult to reduce the electric resistance of the conductive roller without deteriorating the other properties thereof. To solve this problem, various rubber compositions have been proposed, as described below.

For example, as disclosed in Japanese Patent Application Laid-Open No. 2002-20537 (patent document 1), there is proposed the rubber composition containing at least one filler selected from carbon black and silica and the specific sulfur compound. The rubber composition contains silane coupling agent, the plasticizer, and fluoroalkylsulfonate serving as the lubricant.

An ionic-conductive roller has a problem that the electric resistance thereof rises during successive energization. In the case where the ionic-conductive roller is used as a transfer roller of an image-forming apparatus, it is difficult to control a transfer voltage, and a large power unit is required to suppress the rise of the electric resistance thereof. Thus various proposals have been made to reduce the rise of the electric resistance during successive energization.

As disclosed in Japanese Patent Application Laid-Open No. 2002-296930 (patent document 2), there is proposed the charging member having the conductive elastic layer obtained by vulcanizing the mixture of the polyethylene oxide-polypropylene oxide-allyl glycidyl ether terpolymer and the polar rubber. More specifically, the mixture of the polyethylene oxide-polypropylene oxide-allyl glycidyl ether terpolymer, the NBR in which the content of the nitrile is 33.5%, and the EPDM is vulcanized and molded.

The electric resistance value of each of these the conductive rollers is required to fall in the range from $10^4\Omega$ to $10^9\Omega$ (namely, semi-conductive region) in terms of the image-forming mechanism. Ionic-conductive rubber and an ionic-conductive agent are used to impart electric conduction to the roller. Electric current flows in the ionic-conductive roller owing to migration of free ions. Therefore the ionic-conductive roller has a lower degree of applied voltage-caused fluctuation in its electric resistance value than the rubber made conductive by the electroconductive substance.

In the ionic-conductive roller, the mobility of ions is liable to change in dependence on environment such as temperature and humidity. Consequently the electric resistance value of the ionic-conductive roller fluctuates. If the extent of the fluctuation is high, an image-forming apparatus using the ionic-conductive roller requires a large power unit and consumes much electric power to compensate the change of the electric resistance value of the ionic-conductive roller in dependence on environment. Further the image-forming apparatus requires a control system having a complicated construction or a large number of environment tests (operation test that is conducted in different temperatures and humidities). Thus there is an increase in the cost and the period of time required for development.

The conductive roller whose electric resistance value has a low degree of dependence on an applied voltage and has a small variation throughout the entirety thereof has a high degree of dependence on environment. On the other hand, the conductive roller whose electric resistance value has a low degree of dependence on environment has a high degree of dependence on the applied voltage and has a large variation in dependence on portions thereof. To solve this problem and form a preferable image, various proposals have been hitherto made.

For example, there is proposed a semi-conductive roller as disclosed in Japanese Patent Application Laid-Open Nos. 8-334995 (patent document 3) and 10-254215 (patent document 4). In the former, two kinds of carbon blacks are dispersed in the mixture of NBR and EPDM. In the latter, two kinds of carbon blacks are also dispersed in the mixture of NBR, EPDM, and CR. In this semi-conductive roller, owing to the addition of the carbon black, it is possible to control the electric resistance, namely, reduce the fluctuation of the electric resistance and obtain a stable electric resistance value in a wide range without dependence on environment and irrespective of applied voltages.

As disclosed in Japanese Patent Application Laid-Open No. 2001-175098 (patent document 5), there is proposed the rubber roller having the foamed elastic layer containing the polar NBR, the nonpolar EPDM, the conductive agent such as carbon black to reduce fluctuation of the volume specific resistance value in different environments and positional fluctuation of the electric resistance value.

The rubber composition disclosed in Japanese Patent Application Laid-Open No. 2002-20537 (patent document 1) has deteriorated flexibility and is incapable of realizing a low electric resistance in the case where a large mount of the filler such as the carbon black and the silica is added to the rubber component. That is, it is difficult to allow the rubber composition to have favorable electric resistance, hardness, and compression set without deteriorating the other properties thereof. Thus the rubber composition cannot be applied to the conductive roller demanded to be elastic.

In the charging member disclosed in Japanese Patent Application Laid-Open No. 2002-296930 (patent document 2), the content of the nitrile (bound acrylonitrile amount) is as much as 33.5%. Thus the electric resistance of the charging member changes in dependence on environment (temperature and humidity). Another problem of the charging member is that it is made of the ionic-conductive polymer and does not contain an ionic-conductive addition salt. Thus it is impossible to reduce the electric resistance value and the rise thereof during successive energization and the degree of dependence of the electric resistance on environment.

When the charging member whose electric resistance rises during successive energization and whose electric resistance is dependent much on environment is used for an image-forming apparatus, the image-forming apparatus has a complicated mechanism necessarily to prevent the influence given by the charging member. Consequently there is an increase in the cost.

In the semi-conductive roller disclosed in Japanese Patent Application Laid-Open Nos. 8-334995 (patent document 3) and 10-254215 (patent document 4) and the rubber roller disclosed in Japanese Patent Application Laid-Open No. 2001-175098 (patent document 5), the NBR which is ionic-conductive rubber is used in combination with the carbon black which is an electroconductive substance to make use of the advantage of both the NBR and the carbon black. However it is impossible to reduce the fluctuation of the electric resistance in dependence on portions of the roller as well as the degree of dependence of the electric resistance on voltage and reduce the degree of dependence of the electric resistance on environment.

That is, even though the degree of dependence of the electric resistance on environment is reduced to some extent by the addition of the electroconductive substance to the rubber component, there is an increase in the fluctuation of the electric resistance and the degree of dependence of the electric resistance on voltage accordingly. In other words, even though the ratio of the degree of dependence of the electric resistance on environment and the degree of dependence thereof on voltage can be altered, it is impossible to reduce the sum of the degree of dependence of the electric resistance on environment and the degree of dependence thereof on voltage.

When a rubber component such as epichlorohidrin rubber containing chlorine or bromine is used as the ionic-conductive rubber, there is a fear that toxic smoke such as hydrogen chloride and dioxin is generated when it is burnt to discard it. That being the case, the use of the ionic-conductive rubber is disadvantageous in that in discarding the rubber layer, care should be taken not to pollute environment with the toxic smoke.

SUMMARY OF THE INVENTION

The present invention has been made in view of the above-described problems. Therefore it is a first object of the present invention to provide a conductive roller that maintains a low electric resistance value without affecting other performances thereof such as its flexibility, compression set, hardness; has a low extent of dependence on environment in its electric resistance as well as a on a voltage, has small variations in the electric resistance independent of positions thereof to form an image reliably, and does not pollute environment.

It is a second object of the present invention to provide an image-forming apparatus which can be driven by a compact power unit, whose operation can be controlled with a simple control system, can be developed in a short period of time, has high performance, and is inexpensive.

To achieve the object, the present invention provides a conductive roller including at least one conductive elastic layer. The conductive elastic layer formed of a polymer composition includes a main-component polymer not containing chlorine nor bromine and containing polyether or/and a cyano group; and an anion-containing salt having a fluoro group and a sulfonyl group. The anion-containing salt having the fluoro group and the sulfonyl group includes at least one salt selected from among a salt of bisfluoroalkylsulfonylimide, a salt of fluoroalkylsulfonic acid, and a salt of tris(fluoroalkylsulfonyl)methide.

As a result of their energetic researches, the present inventors have found that the electric charge of the anion-containing salt having the fluoro group and the sulfonyl group is not localized owing to a strong electron attraction effect. Thus anions are stable, and the anion-containing salt having the fluoro group and the sulfonyl group displays a high degree of dissociation and allows the conductive elastic layer to have a very high degree of ionic conduction. They have also found that it is possible to realize a low electric resistance efficiently by adding the anion-containing salt having the fluoro group and the sulfonyl group to the rubber component. They have also found that because the anion-containing salt having the fluoro group and the sulfonyl group imparts the ionic conduction effectively to the base polymer, the salt has an action of reducing variations in the electric resistance and the degree of dependence of the electric resistance on a voltage. Thus by appropriately adjusting the mixing ratio of the rubber component, it is possible to provide the conductive elastic layer with a low electric resistance and prevent the photosensitive member from being stained without deteriorating other properties of the conductive elastic layer. They have also found that the addition of the anion-containing salt having the fluoro group and the sulfonyl group has an action of greatly reducing the degree of dependence of the electric resistance value on environment.

The polymer of the conductive elastic layer does not contain chlorine nor bromine. Thus in burning the conductive roller to discard it, there is no fear that it generates toxic smoke such as hydrogen chloride. Therefore the conductive roller of the present invention does not pollute environment.

The polymer not containing chlorine nor bromine contains the polyether or/and the polymer having the cyano group. Thereby it is possible to stabilize cations generated by the dissociation from the salt and accelerate the dissociation of the salt. Thus the polymer composition is allowed to have a higher ionic conduction.

Therefore it is possible maintain a low electric resistance value, reduce the degree of change of the electric resistance in dependence on environment, variations in the electric resistance in dependence on positions of the conductive roller, and the degree of dependence of the electric resistance on a voltage. Thereby it is possible to obtain the conductive roller that allows a high-quality image to be formed reliably and does not pollute environment. That is, the present invention provides the conductive roller suitable for practical use.

It is preferable that the anion-containing salt having the fluoro group and the sulfonyl group is added to the rubber component without the intermediary of a medium, not fixed by crosslinking, which is selected from among low molecular weight polyether-containing compounds whose molecular weight is not more than 10000 or low molecular weight polar compounds whose molecular weight is not more than 10000. Thereby it is possible to obtain the conductive roller that remarkably reduces a possibility of occurrence of bleeding or stain of members disposed in the periphery thereof owing to transfer of toner and that does not stain the photosensitive of a copying machine, a printer, and the like.

More specifically, as the polyether-containing compounds whose molecular weight is not more than 10000, low molecular weight (several hundreds to several thousands) polyethylene glycol, polypropylene glycol, and polyether polyol are listed. As the polar compounds, polyester polyol, adipate, its derivative, and phthalic ester are listed.

Lithium salts are preferable as the anion-containing salt having the fluoro group and the sulfonyl group. Salts of the alkali metals, the group 2A metals, and other metals may be used as the anion-containing salt having the fluoro group and the sulfonyl group. In addition, quaternary ammonium salts, imidazolyl salts, and alkyl-substituted substances thereof are preferable.

As the anion-containing salt having the fluoro group and the sulfonyl group, $LiCF_3SO_3$, $LiN(SO_2CF_3)_2$, $LiC(SO_2CF_3)_3$, $LiCH(SO_2CF_3)_2$, and $LiSF_5CF_2SO_3$ can be used. It is preferable that the anion-containing salt having the fluoro group and the sulfonyl group is dispersed uniformly in the polymer composition.

The polymer containing the polyether or/and the cyano group is contained in the polymer composition favorably at not less than 20 wt % nor more than 90 wt % and more favorably not less than 45 wt % nor more than 75 wt % of the entire polymer component of the polymer composition.

If the polymer containing polyether or/and the cyano group is contained in the polymer composition at less than 20 wt % of the entire polymer component, there is a fear that a sufficiently low electric resistance value cannot be obtained and that the polymer containing the polyether or/and the cyano group is not uniformly dispersed and causes the electric resistance value to be nonuniform. On the other hand, if the polymer containing polyether or/and the cyano group is contained in the polymer composition at more than 90 wt % of the entire polymer component, there is a fear that ozone cracking occurs and that the electric resistance value rises greatly when a voltage is successively applied to the conductive roller for a long time.

The following polymers are preferable as the polymer containing the polyether: ethylene oxide-propylene oxide-allyl glycidyl ether copolymer, ethylene oxide-allyl glycidyl ether copolymer, propylene oxide-allyl glycidyl ether copolymer, ethylene oxide-propylene oxide copolymer, and urethane rubber. As the polymer having the cyano group, the following ionic-conductive polymers are preferable: acrylonitrile butadiene rubber (NBR), hydrogenated acrylonitrile butadiene rubber, carboxyl-modified acrylonitrile butadiene rubber, acrylonitrile butadiene isoprene terpolymer (NBIR), and liquid nitrile rubber. These polymers can be used singly or in combination. The polymer containing the polyether and the polymer having the cyano group may be used in combination.

By using the polymer containing the polyether or/and the cyano group in combination with the low polar ozone-resistant rubber as the polymer not containing chlorine nor bromine, it is possible to suppress variations in the electric resistance value and make the ozone-resistant property preferable. It is also possible to reduce the material cost because it is possible to reduce the use amount of the anion-containing salt having the fluoro group and the sulfonyl group. The weight ratio between the polymer containing the polyether or/and the cyano group and the low polar ozone-resistant rubber is favorably 90:10 to 20:80 and more favorably 80:20 to 30:70 and most favorably 75:25 to 45:55.

The EPDM is preferable as the low polar ozone-resistant rubber. The main chain of the EPDM consists of saturated hydrocarbons and does not have double bonds. Therefore, even though the EPDM is exposed to a high-density ozone atmosphere or irradiated with light for a long time, the molecular main chain is hardly cut. Accordingly, the polymer composition is allowed to be ozone-resistant. The EPDM is contained in the polymer composition favorably at not less than 10 wt % nor more than 80 wt % of the entire polymer component and more favorably not less than 20 wt % nor more than 70 wt % thereof and much more favorably not less than 30 wt % nor more than 65 wt % thereof.

In addition to the EPDM, it is possible to select one or more low polar ozone-resistant rubbers from among ethylene propylene rubber (EPM), styrene-butadiene copolymer rubber (SBR), butyl rubber (IIR), silicone rubber (Q).

It is preferable that the polymer composition contains carbon black as a filler. It is also preferable that the low polar ozone-resistant rubber is dispersed in the polymer component as the master batch for the carbon black. Thereby the carbon black can be dispersed collectively in the low polar ozone-resistant rubber.

The polymer composition may contain a softener such as oil, an age resistor, and a filler as necessary.

It is favorable to add not more than 30 parts by weight of the carbon black to 100 parts by weight of the entire polymer component. This is because if more than 30 parts by weight of the carbon black is added to 100 parts by weight of the entire polymer component, the electroconductive path surpasses the ionic-conductive path. Consequently there is a large variation in the electric resistance value. It is more favorable to add not less than 2 parts by weight nor more than 20 parts by weight of the carbon black to 100 parts by weight of the entire polymer component.

The polymer not containing chlorine nor bromine but containing polyether or/and a cyano group and the anion-containing salt having the fluoro group and the sulfonyl group are added to the polymer component. As the polymer not containing chlorine nor bromine, the polymer composition contains the polymer containing the polyether or/and the cyano group. Thereby the electrical performance of the conductive roller is optimized, as will be described below.

An electric resistance value of the conductive roller measured by applying a voltage of 1000V thereto at a temperature of 23° C. and a relative humidity of 55% is not less than $10^4\Omega$ nor more than $10^9\Omega$. That is, the polymer composition is allowed to have a low electric resistance. In this condition, the conductive roller has an electric resistance favorably not less than $10^5\Omega$ nor more than $10^{8.5}\Omega$ and more favorably not less than $10^{5.5}\Omega$ nor more than $10^8\Omega$. Thereby the conductive roller composed of the polymer composition can be suitably used as a developing roller, a charging roller, a transfer roller, and the like for use in a copying machine or a printer.

If the electric resistance is less than $10^4\Omega$, high current flows and there is a possibility that leak-caused defective image is formed. On the other hand, if the electric resistance is more than $10^9\Omega$, transfer, charging, and toner supply are performed at a low efficiency. Hence the conductive roller composed of the polymer composition cannot be put into practical use. In addition, the conductive roller has a large power consumption.

The ratio of the maximum value of the electric resistance of the conductive roller in its circumferential direction to the minimum value of the electric resistance thereof in its circumferential direction at the voltage of 1000V applied thereto is set to not more than 1.3. Thereby the conductive roller is capable of having a small circumferential nonuniformity in its electric resistance value. More specifically, the maximum value and minimum value of the electric resistance of the conductive roller in the circumferential direction thereof are measured by applying the voltage of 1000V thereto at the ambient temperature of 23° C. and the relative humidity of 55% by using a method which will be described later. The circumferential nonuniformity of the electric resistance value is obtained by dividing the maximum value of the electric resistance value by the minimum value thereof in the circumferential direction of the conductive roller. The value thus obtained is used to evaluate the peripheral nonuniformity. The value of the circumferential nonuniformity is favorably not less than 1.0 nor more than 1.2, more favorably not less than 1.0 nor more than 1.15, and most favorably not less than 1.0 nor more than 1.10.

When the electric resistance value R(Ω) of the conductive roller is measured in two different conditions, namely, at a temperature of 10° C. and a relative humidity of 15% and at a temperature of 32.5° C. and a relative humidity of 90% by applying a voltage of 1000V thereto, the value of an equation of $\Delta \log_{10}R=\log_{10}R$ (electric resistance value at temperature of 10° C. and a relative humidity of 15%)−$\log_{10}R$ (electric resistance value at temperature of 32.5° C. and a relative humidity of 90%) is not more than 1.4 or 1.3, favorably not more than 1.2, more favorably not more than 1.1, and most favorably not more than 1.0. Thereby the conductive roller is very little adversely affected by temperature or humidity.

The difference between the common logarithm of the electric resistance value of the conductive roller measured by applying a voltage of 100V thereto at a temperature of 23° C. and a relative humidity of 55% and the common logarithm of the electric resistance value thereof measured by applying a voltage of 5000V thereto at a temperature of 23° C. and a relative humidity of 55% is set to not more than 0.5, favorably not more than 0.3, and most favorably not more than 0.2. Thereby the performance of the conductive roller is very little affected in dependence on a voltage applied thereto. Further the conductive roller is dependent on a voltage to a low extent.

The ratio of an electric resistance value of the conductive roller when six seconds elapse after a constant voltage of 1000V is applied thereto to an electric resistance value thereof at a time when the constant voltage of 1000V is applied thereto at a temperature of 10° C. and a relative humidity of 15% is set to not less than 100% nor more than 105%. Thereby it is possible to suppress the rise of the electric resistance value immediately after the constant voltage is applied to the conductive roller. Thus the conductive roller has a stable electric resistance value. The reason the above-described ratio is specified at the low temperature and humidity (10° C., relative humidity of 15%) is because the electric resistance value of the ionic-conductive conductive roller is apt to rise in the low temperature and humidity. Hence it is difficult to obtain stability in the electric resistance value.

It is preferable that the conductive elastic layer has a compression set not more than 35% when the compression set is measured at a temperature of 70° C. for 24 hours at a compressibility ratio of 25% in accordance with "method of testing permanent strain of vulcanized rubber and thermoplastic rubber" specified in JIS K6262.

If the value of the compression set of the conductive elastic layer is more than 35%, the dimensional change of the conductive roller composed of the polymer composition is so large that they cannot be put into practical use. In the case where the conductive elastic layer is used as a foamed (sponge) conductive roller, it is preferable to set the compression set thereof to the above range, although the compression set of the foamed conductive roller is a little different from that of the unfoamed conductive roller in dependence on an expansion rate and an expansion mode.

It is preferable that the conductive elastic layer has a hardness not more than 70 degrees when the hardness is measured by a durometer of type E specified in JIS K6253. This is because the softer the conductive elastic layer, the larger the nip. Consequently transfer, charging, and development can be efficiently accomplished. In addition, it is possible to reduce mechanical damage to other members such as the photosensitive member of the printer or the like.

It is preferable that the conductive elastic layer formed of a polymer composition having a rubber component containing a mixture of ethylene-propylene-diene terpolymer (EPDM) and acrylonitrile butadiene rubber (NBR) as a main component thereof; not less than 0.01 parts by weight nor more than 20 parts by weight of an anion-containing salt having a fluoro group and a sulfonyl group added to 100 parts by weight of the rubber component; and a chemical foaming agent to foam the conductive roller.

It is also preferable that the conductive elastomer composition has a compression set not more than 30% when the compression set is measured at a temperature of 70° C. for 24 hours at a compressibility ratio of 25% in accordance with the method of testing permanent strain of vulcanized rubber and thermoplastic rubber specified in JIS K6262.

The conductive roller is composed of the rubber component containing the mixture of the ethylene-propylene-diene terpolymer (EPDM) and the acrylonitrile butadiene rubber (NBR) as the main component thereof; the chemical foaming agent; and the above-specified parts by weight of the anion-containing salt, having the fluoro group and the sulfonyl group, which has a favorable affinity for the rubber component. Thereby the foamed conductive elastic layer has a low hardness to allow the conductive roller to have a proper hardness. The anion-containing salt having the fluoro group and the sulfonyl group is capable of greatly reducing the electric resistance of the conductive elastic layer by adding a small amount thereof to the rubber component. Thus the addition of the anion-containing salt having the fluoro group and the sulfonyl group does not cause deterioration of other properties (hardness, compression set, and the like) of the conductive elastic layer. Consequently, the addition of the anion-containing salt having the fluoro group and the sulfonyl group leads to the realization of a low electric resistance of the conductive elastic layer without deteriorating other properties thereof.

Since the conductive elastic layer of the conductive roller is formed of the rubber component containing the mixture of the EPDM and the NBR, the conductive elastic layer is resistant to ozone. Since the conductive elastic layer does not contain the halogen component such as chlorine nor bromine, the halogen component does not make a secondary reaction. Further it is possible to realize the reduction of the compression set and the electric resistance value of the conductive roller. Thus in burning the conductive roller to discard it, there is no fear that it generates toxic smoke such as hydrogen chloride. Therefore the conductive roller of the present invention does not pollute environment.

The acrylonitrile butadiene rubber (NBR) allows the compression set and the hardness to be low and is compatible with the anion-containing salt having the fluoro group and the sulfonyl group. Both the EPDM and the NBR are general-purpose rubber. Thus the material cost is inexpensive. For the above described reason, it is preferable that the mixture of the EPDM and the NBR is 60 wt % of the entire weight of the rubber component. It is optimum that the rubber component consists of the above-described mixture. As mixable rubbers, styrene-butadiene rubber (SBR), butyl rubber (IIR), silicone rubber, isoprene rubber, natural rubber, and the like are listed.

Ethylene propylene rubber (EPM), SBR, and silicone rubber may be used instead of the EPDM. Instead of the NBR, it is possible to use hydrogenated acrylonitrile butadiene rubber, carboxyl-modified acrylonitrile butadiene rubber, acrylonitrile butadiene isoprene terpolymer (NBIR), and liquid nitrile rubber. In addition, a necessary amount of these rubbers may be mixed with the NBR.

Therefore it is possible to adjust the electric resistance value in a low electric resistance region and allow the conductive roller composed of the polymer composition to have preferable mechanical properties (low compression set and hardness) as a conductive foamed roller. That is, the conductive roller of the present invention is suitable for practical use and does not pollute environment.

That is, the foamed layer has a compression set not more than 30% when the compression set is measured at a temperature of 70° C. for 24 hours at a compressibility ratio of 25% in accordance with "method of testing the permanent strain of vulcanized rubber and thermoplastic rubber" specified in JIS K6262. If the compression set of the foamed layer is not less than 30%, the conductive foamed roller has a large dimensional change. Thus the conductive foamed roller is unsuitable for practical use, although the compression set of the foamed conductive roller is a little different from that of the unfoamed conductive roller in dependence on an expansion rate and an expansion mode. The compression set of the foamed layer is more favorably not more than 25% and most favorably not more than 20%.

The conductive elastic layer contains not less than 0.01 nor more than 20 parts by weight of the anion-containing salt having the fluoro group and the sulfonyl group for 100 parts by weight of the polymer component. The reason is as follows: If the conductive elastomer composition contains less than 0.01 parts by weight of the salt for 100 parts by weight of the entire polymer component, the effect of improving the electric conduction can be hardly obtained. On the other hand, if the conductive elastomer composition contains more than 20 parts by weight of the salt for 100 parts by weight thereof, the conductive elastic layer has a large value in its compression set, and the disadvantage of the increase in the material cost is large for the degree of the conduction-improving effect obtained by the use of a large amount of the salt.

The conductive elastic layer contains the anion-containing salt having the fluoro group and the sulfonyl group favorably at not less than 0.1 nor more than 10 parts by weight, more favorably at not less than 0.2 nor more than 6 parts by weight, and at most favorably at not less than 0.3 nor more than 4 parts by weight for 100 parts by weight of the entire rubber component.

The cations dissociated from the salt can be stabilized by the cyano group contained in the NBR which is one of the main components of the rubber component of the conductive elastic layer. Thus the salt can be dispersed and dissolved uniformly in the in the polymer composition without using a medium.

The EPDM is used as the rubber component for the following reason: The main chain of the EPDM consists of saturated hydrocarbons and does not have double bonds. Therefore, even though the EPDM is exposed to a high-density ozone atmosphere or irradiated with light for a long time, the molecular main chain is hardly cut. Accordingly, even though ozone is generated in an image-forming apparatus of a copying apparatus, it is possible to reduce the degree of ozone-caused deterioration and enhance weatherability of an obtained conductive foamed roller.

As the EPDM, there is no limitation in its diene component. It is possible to use ethyledene-norbornene (ENB), dichloropendadiene (DCPD), and vinyl norbornene. It is possible to use the EPDM of both the oil-unextended type consisting of a rubber component and the oil-extended type containing the rubber component and an extended oil. The weight of the EPDM of the oil-extended type means the weight of only the content of the rubber.

The reason the NBR is used as the rubber component is because the NBR is capable of reducing the compression set and the hardness of the conductive elastic layer. The NBR is preferable because it is ionic-conductive and compatible with the anion-containing salt having the fluoro group and the sulfonyl group to be added to the polymer component and is general-purpose rubber. Thus the material cost is inexpensive. Low-nitrile NBR is preferable because it is compatible with the EPDM. The low-nitrile NBR allows the degree of dependence of the mobility of its molecules on temperature to be lower in a region in which the conductive roller is used than intermediate/high-nitrile NBR and high-nitrile NBR. Thus the low-nitrile NBR allows the degree of dependence of the electric resistance value on environment to be low. It is possible to use various acrylonitrile butadiene rubbers such as intermediate-nitrile, the intermediate/high-nitrile NBR, the high-nitrile NBR, and super-high nitrile.

It is favorable that the weight ratio between the ethylene-propylene-diene terpolymer rubber and the acrylonitrile butadiene rubber is 75:25 to 20:80. Thereby it is possible to obtain preferable resistance to ozone and a low electric resistance. If the ratio of the ethylene-propylene-diene terpolymer to the total weight of the mixture of the rubbers is less than 20 wt %, the polymer composition has a low resistance to ozone. On the other hand, if the ratio of the ethylene-propylene-diene terpolymer to the total weight of the mixture of the rubbers is more than 75 wt %, the conductive roller is incapable of obtaining a low electric resistance value, has an unfavorable compression set, and stains the photosensitive member.

It is more favorable that the weight ratio between the ethylene-propylene-diene terpolymer and the acrylonitrile butadiene rubber is 55:45 to 25:75.

The following polymer components may be added to the above-described rubber component: an ethylene oxide(EO)-propylene oxide(PO)-allyl glycidyl ether(AGE) terpolymer, an EO-AGE bipolymer, and a PO-AGE bipolymer. Thereby it is possible to stabilize the anion-containing salt having the fluoro group and the sulfonyl group to a higher extent. It is preferable to add not less than 1 part by weight nor more than 30 parts by weight of these polymer components to 100 parts by weight of the rubber component.

The foaming start temperature can be adjustably by altering the kind, amount, and the mixing ratio of the chemical foaming agent or the mixing ratio of a foaming assistant. Thus it is preferable to use organic foaming agents of chemical reaction type such as azodicarbonamide (ADCA) and/or 4,4'-oxybis (benzene sulfonyl hydrazide) (OBSH) as the chemical foaming agent. The generation curve of a foaming gas can be adjusted by using these chemical foaming agents in combination. In addition, N,N-dinitrosopentamethylenetetramine (DPT) can be used as the chemical foaming agent.

As a foaming assistant, urea is preferable since it is capable of reducing the foaming start temperature of the ADCA. It is preferable to use the urea serving as the foaming assistant for the ADCA. In the case where the polymer composition is foamed with only the OBSH, the foaming assistant may or may not be added to the polymer composition.

It is favorable that not less than 3 parts by weight nor more than 12 parts by weight of the chemical foaming agent is added to 100 parts by weight of the rubber component. If less 3 parts by weight of the chemical foaming agent is added to 100 parts by weight of the rubber component, the amount of the foaming agent is insufficient. Thus the polymer composition has an insufficient flexibility. On the other hand, if more than 12 parts by weight of the chemical foaming agent is added to 100 parts by weight of the rubber component, the foaming agent inhibits vulcanization. As a result, there is a fear that insufficient vulcanization takes place and the polymer composition has an insufficient strength. It is more favorable that not less than 4 parts by weight nor more than 8 parts by weight of the chemical foaming agent is added to 100 parts by weight of the rubber component.

Thereby the polymer composition has an improved flexibility. When a transfer roller composed of the polymer composition presses a transfer member, a toner image has little irregularities and a preferable image can be obtained.

The expansion rate (volume %) is not less than 100% nor more than 500% and favorably not less than 200% nor more than 300%. Foamed cells are present uniformly in a flamed layer. The diameter of the foamed cell is not less than 100 μm nor more than 300 μm and favorably not less than 20 μm nor more than 200 μm.

It is preferable that not more than 12 parts by weight of the foaming assistant is added to 100 parts by weight of the rubber component. If more than 12 parts by weight of the foaming assistant is added to 100 parts by weight of the rubber component, vulcanization inhibition is liable to take place. To drop a foaming temperature, it is preferable to add not less than one part by weight of the foaming assistant to 100 parts by weight of the rubber component.

The addition of a chemical foaming agent to the rubber component allows the rubber composition to be sponge-like and allows the conductive foamed roller to have a hardness not less than 20 nor more than 40 and favorably not less than 25 nor more than 35. The conductive foamed roller having a hardness in this range can be used as a transfer roller or the like which requires a proper nip width. Thereby it is possible to increase the nip width when the conductive foamed roller is pressed against a member for holding an electrostatic latent image.

If the Shore E hardness measured by a durometer of type E of the conductive roller is less than 20, the conductive roller is so soft that it has a large value in its compression set. On the other hand, if the Shore E hardness is more than 40, the conductive roller is so hard that it is worn greatly and a defective image is liable to be generated when the conductive roller contacts a stiff photosensitive member.

The present invention provides a conductive roller in which a chemical foaming agent is added to a mixture of acrylonitrile butadiene rubber (NBR) having a bound acrylonitrile amount at not more than 25%, ethylene-propylene-diene terpolymer (EPDM), and polyethylene oxide-polypropylene oxide-allyl glycidyl ether terpolymer (PO-EO-AGE terpolymer) to foam the mixture.

Owing to their energetic investigations and experiments of the kind and mixing amount of polymers and ionic-conductive addition salts composing the conductive foamed roller, the present inventors have found preferable kinds and mixing amounts thereof allowing the conductive foamed roller to have ion-caused preferable electrical characteristics and reduction in the degree of dependence of the electric resistance value thereof on environment and reduction in the rise of the electric resistance thereof during successive energization.

More specifically, not more than 2 parts by weight and favorably 1 part by weight of the anion-containing salt having the fluoro group and the sulfonyl group is added to 100 parts by weight of a mixture of acrylonitrile butadiene rubber (NBR) having the bound acrylonitrile amount at not more than 25%, ethylene-propylene-diene terpolymer (EPDM), and polyethylene oxide-polypropylene oxide-allyl glycidyl ether terpolymer (PO-EO-AGE terpolymer). Thereby the ionic-conductive conductive roller has excellent electrical characteristics.

That is, it is possible to maintain a sufficiently low electric resistance, reduce the degree of dependence of the electric resistance on environment (temperature and humidity), and suppress the rise of the electric resistance during successive energization. Because a small amount of the anion-containing salt having the fluoro group and the sulfonyl group is used for the mixture of the rubbers, the addition of the chemical foaming agent to the mixture of the rubbers does not adversely affect other properties of the conductive roller such as its hardness and compression set. Further since the conductive roller is ionic-conductive, there is a small variation in the electric resistance, and the electric resistance can be adjusted easily.

The acrylonitrile butadiene rubber (NBR) whose bound acrylonitrile amount is not more than 25% has a small difference in the loss tangent δ of the viscoelasticity at 10° C. and the loss tangent δ thereof at 32° C. Further the NBR whose bound acrylonitrile amount is not more than 25% has a low glass transition temperature Tg. Therefore in the NBR whose bound acrylonitrile amount is not more than 25%, the molecular mobility has a lower degree of dependence on temperature than that of intermediate/high-nitrile NBR and high-nitrile NBR both having a large bound acrylonitrile amount. Since the NBR whose bound acrylonitrile amount is not more than 25% shows a very favorable characteristic in the vicinity of the room temperature, the conductive roller composed of the polymer composition is dependent on environment to a low extent. Furthermore the NBR whose bound acrylonitrile amount is not more than 25% is compatible with the EPDM. The bound acrylonitrile amount is favorably in the range of 18% to 20%.

The NBR, the EPDM, and the PO-EO-AGE copolymer are mixed with one another at not less than 50 parts by weight nor more than 80 parts by weight, at not less than 0.5 parts by weight nor more than 30 parts by weight, and at not less than 0.5 parts by weight nor more than 30 parts by weight respectively for 100 parts by weight of the mixture.

If the weight ratio of the NBR having the bound acrylonitrile amount at not more than 25% is set to less than 50 parts by weight, it is impossible to reduce the degree of dependence of the electric resistance value on environment, the compression set becomes large, and the photosensitive member is liable to be stained. If the weight ratio of the NBR is set to more than 80 parts by weight, the polymer composition is liable to be deteriorated by ozone.

If less than 0.5 parts by weight of the EPDM is used, the electric resistance value increases during successive energization. If more than 30 parts by weight of the EPDM is used, it is difficult to obtain the effect, which is brought about by the NBR, of reducing the degree of dependence of the electric resistance value on environment. As described previously, the main chain of the EPDM consists of saturated hydrocarbons and does not have double bonds. Therefore, even though the EPDM is exposed to a high-density ozone atmosphere or irradiated with light for a long time, the molecular main chain is hardly cut. Accordingly, the polymer composition is allowed to be ozone-resistant.

The PO-EO-AGE copolymer is capable of stabilizing the cations generated by the dissociation from the salt and accelerating the dissociation of the salt. Thus the polymer composition is allowed to have a higher ionic conduction.

If less than 0.5 parts by weight of the PO-EO-AGE is used, the electric resistance value increases during successive energization. If more than 30 parts by weight of the PO-EO-AGE is used, it is difficult to obtain the effect, which is brought about by the NBR, of reducing the degree of dependence of the electric resistance value on environment, and the photosensitive member is liable to be stained.

It is preferable that polyethylene oxide (PO), polypropylene oxide (EO), and allyl glycidyl ether terpolymer (AGE) are copolymerized at 50 to 95 mol %, 1 to 49 mol %, and 1 to 10 mol % respectively. The number-average molecular weight Mn of the PO-EO-AGE is favorably not less than 10000. By increasing the copolymerization ratio of the polyethylene oxide, cations of the rubber composition can be stabilized to a higher extent.

Not less than 0.5 parts by weight nor more than 2 parts by weight of the anion-containing salt having the fluoro group and the sulfonyl group is added to 100 parts by weight of the mixture of the rubbers. If less than 0.5 parts by weight of the salt is added to 100 parts by weight of the mixture of the rubbers, the effect of improving the electric conduction can be hardly obtained. On the other hand, if more than 2 parts by weight of the salt is added to 100 parts by weight of the mixture of the rubbers, the disadvantage of the increase in the material cost is large for the degree of the conduction-improving effect obtained by the use of a large amount of the salt. It is favorable to add 1 part by weight of the anion-containing salt having the fluoro group and the sulfonyl group to 100 parts by weight of the mixture of the rubbers.

It is preferable that the rubber composition contains an antioxidant. Thereby it is possible to effectively reduce the degree of dependence of the electric resistance value on environment and the rise of the electric resistance during successive energization to a higher extent. As the antioxidant, NEC and NBC can be used. It is preferable to add not less than 0.1 parts by weight nor more than five parts by weight of the antioxidant to 100 parts by weight of the mixture of the rubbers.

As the rubber component, it is possible to use ethylene propylene rubber (EPM), stylene-butadiene rubber (SBR), butyl rubber (IIR), and silicone rubber (Si), and copolymers. A vulcanizing agent, a softener such as oil, an age resistor, and a filler may be added to the rubber component as necessary.

As the vulcanizing agent, sulfur is preferable because it is capable of realizing a low electric resistance. It is also possible to use organic sulfur-containing compounds and peroxides. As the organic sulfur-containing compound, it is possible to use tetramethylthiuram disulfide and N,N-dithiobismorpholine. As the peroxide, it is possible to use benzoyl peroxide and dixyl peroxide. In performing vulcanization and foaming, the sulfur is favorable, because the sulfur allows a vulcanization speed and a foaming speed to be favorably balanced with each other. The vulcanizing agent is added to the rubber component favorably at not less than 0.5 parts by weight nor more than 5 parts by weight and more favorably not less than 1 part by weight nor more than 3 parts by weight.

The following vulcanizing accelerators may be added to the rubber component: inorganic accelerators such as slaked lime, magnesia (MgO), litharge (PbO); and organic accelerators shown below.

As the organic accelerator, it is possible to use the following substances in combination: thiazoles such as 2-melcapto.benzothiazole, dibenzothiazolyl disulfide, N-cyclohexyl-2-benzothiazolesulfenamide; sulfinamides; thiurams such as tetramethylthiuram monosulfide, tetramethylthiuram disulfide, tetraethylthiuram disulfide, and dipentamethylenethiuram tetrasulfide; and thioureas.

The vulcanizing accelerators are added to the rubber component favorably at not less than 0.5 parts by weight nor more than 5 parts by weight and at more favorably not less than two parts by weight nor more than 4 parts by weight for 100 parts by weight of the rubber component.

The following vulcanizing accelerating assistants may be added to the rubber component: metal oxides such as zinc white; fatty acids such as stearic acid, oleic acid, cotton seed fatty acid; and known vulcanizing accelerating assistants.

The following fillers may be added to the rubber component as necessary: powdered substances such as silica, carbon black, clay, talc, calcium carbonate, dibasic lead phosphite (DLP), basic magnesium carbonate, alumina, titanium oxide, and barium titanate. It is favorable to add not more than 30 wt % of the filler for the entire conductive foamed roller. This is because although the addition of the filler to the rubber component is effective for improving the tensile strength and tear strength of the rubber composition, the addition of too much amount of the filler deteriorates the flexibility of the rubber composition greatly.

It is preferable to use the anion-containing salt having the fluoro group and the sulfonyl group in combination with the barium titanate serving as the filler, because the barium titanate has an action of improving the electric conduction of the polymer composition.

It is preferable to add the filler at not more than 30 wt % for the entire rubber composition. The filler is added to the rubber component as necessary to improve the mechanical strength of the conductive roller or improve processability in an unvulcanized state, so long as the filler does not affect the electric resistance of the conductive foamed roller adversely.

The conductive roller of the present invention can be produced by using a conventional method. For example, the rubber composition (mixture) whose components have been mixed with one another in a predetermined ratio is supplied to a rubber-kneading apparatus such as an open roll, a Banbury mixer or the like. After the rubber composition is kneaded at for 1 to 20 minutes, it is tubularly preformed by a single-axis extruder. After the preform is vulcanized at 160° C. for 10 to 70 minutes, a core metal is inserted into a hollow portion of the tube. After the surface of the tube is polished, the tube is cut to a predetermined size to obtain a rubber roller. The kneaded rubber composition is vulcanized by an electric press machine, a vulcanizing can, electron beams, and the like. The vulcanizing time period should be set by using a vulcanization testing rheometer (for example, Curast meter), although it varies according to the kind of the rubber component, the vulcanizing agent and the like, the mixing ratio among the components, the kind and amount of the foaming agent and the foaming assistant. The vulcanization temperature may be set around 160° C. in dependence on necessity. To suppress the stain of the photosensitive member, it is preferable to set the vulcanization temperature and the vulcanization time period so that sufficient vulcanization can be accomplished.

An unvulcanized rubber composition to be foamed can be vulcanized with a vulcanizing can which vulcanizes the rubber composition directly by pressurized water vapor.

The kneaded rubber composition can be molded before or while it is being vulcanized. For example, after the kneaded rubber composition is molded compressively in a roller-shaped die, the die is heated to vulcanize it. Alternatively, the rubber composition may be vulcanized while it is being molded into a desired configuration such as a tubular configuration (roller configuration) by injection molding, transfer molding or extrusion.

The cylindrical foamed layer has a thickness of favorably 2 mm to 8 mm and more favorably 3 mm to 5 mm. If the conductive elastic layer has a thickness less than 2 mm, it is difficult to obtain a nip having a proper dimension. On the other hand, if the conductive elastic layer has a thickness more than 8 mm, it is difficult to make the conductive roller compact.

The conductive roller of the present invention may have one conductive elastic layer or two or three rubber layers in addition to the conductive elastic layer to adjust the electric resistance of the conductive roller and protect the surface thereof. In this case, it is possible to appropriately adjust the mixing ratio of the components of each layer, the layering order, and the thickness of each layer. It is preferable that the conductive elastic layer is formed as the innermost layer. It is preferable that the core metal is made of metal such as aluminum, aluminum alloy, SUS, iron. It is possible to prevent powdered paper or toner from attaching to the surface of the conductive roller by irradiating the surface thereof with ultraviolet rays or coating the surface thereof with a coating material.

The present invention provides an image-forming apparatus having the conductive roller of the present invention. As described above, the conductive roller of the present invention is superior in its electrical characteristics and dependent on environment to a low extent in its electric resistance. Therefore image-forming apparatuses such as a copying apparatus, a printer, a facsimile, and the like having the conductive roller of the present invention can be driven by a small power unit, and the operation thereof can be controlled by a control system having a simple construction. Further it is possible to reduce the number of evaluation tests and accomplish development in a short period of time. Thereby it is possible to obtain a high-performance and inexpensive image-forming apparatus. The conductive roller is used as a charging roller for uniformly charging a photosensitive drum, a developing roller for attaching toner to the photosensitive member, a transfer roller for transferring a toner image from the photosensitive member to paper or an intermediate transfer belt, and a toner supply roller for transporting the toner. The toner and the photosensitive member are charged or discharged by bringing the surface of the conductive member into contact with the member to be charged.

DETAILED DESCRIPTION OF THE PREFERRED EMBODIMENTS

The embodiments of the present invention will be described below with reference to the drawings.

Figure 1:
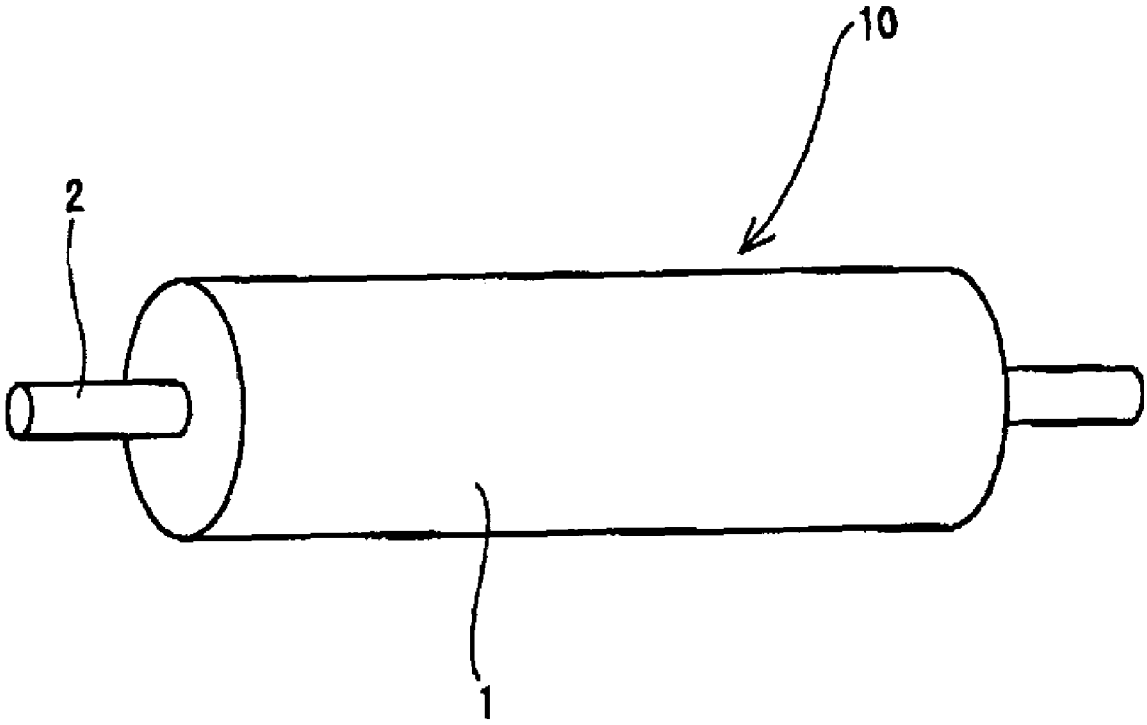
FIG. 1 is a schematic view showing a conductive roller of the present invention.

FIG. 1 shows a conductive roller 10 of the first embodiment. The conductive roller 10 has a conductive columnar aluminum core metal 2 and a cylindrical conductive elastic layer 1 disposed on the peripheral surface of the core metal 2. The core metal 2 is mounted in a hollow portion of the conductive elastic layer 1 by press fit.

The conductive elastic layer 1 is formed of a polymer composition containing a polymer not containing chlorine nor bromine and an anion-containing salt having a fluoro group and a sulfonyl group. More specifically, a mixture of 70 parts by weight of acrylonitrile butadiene rubber, not containing chlorine nor bromine, which has a cyano group and 30 parts by weight of EPDM, not containing chlorine nor bromine, which is a low-polar ozone-resistant rubber is used as the polymer component. As the anion-containing salt having the fluoro group and the sulfonyl group, lithium-bis (trifluoromethanesulfonyl)imide which is one of salts of bisfluoroalkylsulfonylimide is used.

The anion-containing salt having the fluoro group and the sulfonyl group is added to the polymer component without the intermediary of a medium, not fixed by crosslinking, which consists of a low molecular weight (not more than 10000) polyether compound or a low molecular weight polar compound.

It is preferable that the polymer composition contains carbon black. The carbon black is dispersed in the polymer component as the master batch for the EPDM. The EPDM is contained at 30 wt % of the whole rubber component. The anion-containing salt having the fluoro group and the sulfonyl group and the carbon black HAF are used at 0.6 parts by weight and 10 parts by weight respectively for 100 parts by weight of the polymer component.

The following agents are added in a necessary amount to the rubber component to form a polymer composition: A chemical foaming agent, powdered sulfur serving as a vulcanizing agent (sulfur), and a vulcanizing accelerator. After the polymer composition is kneaded, it is extruded cylindrically by an extruder to preform it. The obtained preform is cut to a predetermined size. The preform is supplied to a vulcanizing can of a pressure/water vapor type. In the vulcanizing can, the chemical foaming agent gasifies and foams, and the rubber component is vulcanized at a rubber component-crosslinking temperature.

Vulcanizing conditions are adjusted according to the kind of the rubber component, additives such as the chemical foaming agent, and the vulcanizing agent and mixing ratios among the components. After a shaft, namely, the core metal 2 is inserted into the hollow portion of the obtained cylindrical conductive elastic layer 1, the peripheral surface of the conductive elastic layer 1 is polished and the conductive elastic layer 1 is cut.

The conductive elastic layer 1 has a compression set of 20% when the compression set is measured at a temperature of 70° C. for 24 hours in accordance with "method of testing permanent strain of vulcanized rubber and thermoplastic rubber" specified in JIS K6262. The conductive elastic layer has a hardness of 32 degrees when its hardness is measured by the durometer of type E.

In the conductive roller 10, an electric resistance value of the conductive roller measured by applying a voltage of 1000V thereto at a temperature of 23° C. and a relative humidity of 55% is set to $10^{7.7}\Omega$. When the voltage of 1000V is applied to the conductive roller, the ratio of a maximum value of an electric resistance of the conductive roller in the circumferential direction thereof to a minimum value of the electric resistance thereof is set to 1.05. When an electric resistance value R(Ω) of the conductive roller is measured at a temperature of 10° C. and a relative humidity of 15% and at a temperature of 32.5° C. and a relative humidity of 90% by applying the voltage of 1000V thereto, the value of an equation of $\Delta \log_{10}R=\log_{10}R$ (electric resistance value at temperature of 10° C. and relative humidity of 15%)$-\log_{10}R$(electric resistance value at temperature of 32.5° C. and relative humidity of 90%) is set to 1.0. The difference between the common logarithm of an electric resistance value of the conductive roller measured by applying a voltage of 100V thereto at a temperature of 23° C. and a relative humidity of 55% and the common logarithm of an electric resistance value measured by applying a voltage of 5000V thereto at a temperature of 23° C. and a relative humidity of 55% is set to 0.2. The ratio of an electric resistance value of the conductive roller six seconds after a constant voltage of 1000V is applied thereto to an electric resistance value thereof at a time when the constant voltage of 1000V is applied thereto at a temperature of 10° C. and a relative humidity of 15% is set to 101%.

The conductive elastic layer of the conductive roller 10 is composed of the polymer composition including the polymer not containing chlorine nor bromine and the anion-containing salt, having the fluoro group and the sulfonyl group, added to the polymer. Therefore the conductive roller 10 is allowed to maintain a low electric resistance value, have a low extent of environment-caused change in its electric resistance and small variations with time, and have small variations in its electric resistance independent of positions thereof. Thereby it is possible to form an image preferably and reliably. Further since the conductive roller 10 does not generate toxic smoke when it is burnt, it does not pollute environment. Therefore the conductive roller 10 can be used preferably as a developing roller, a charging roller, a transfer roller, and the like. The conductive roller 10 can be used suitably for a color copying apparatus or a color printer demanded to form a high-quality image.

As an image-forming apparatus using the conductive roller of the present invention, a color printer having a construction including an intermediate transfer belt is described below with reference to FIG. 2. The conductive roller of the present invention is used as the transfer roller for the color printer. The color printer has transfer rollers 10A and 10B, a charging roller 11, a photosensitive member 12, an intermediate transfer belt 13, a fixing roller 14, toner in four colors 15 (15A, 15B, 15C, and 15D), and a mirror 16.

Figure 2:
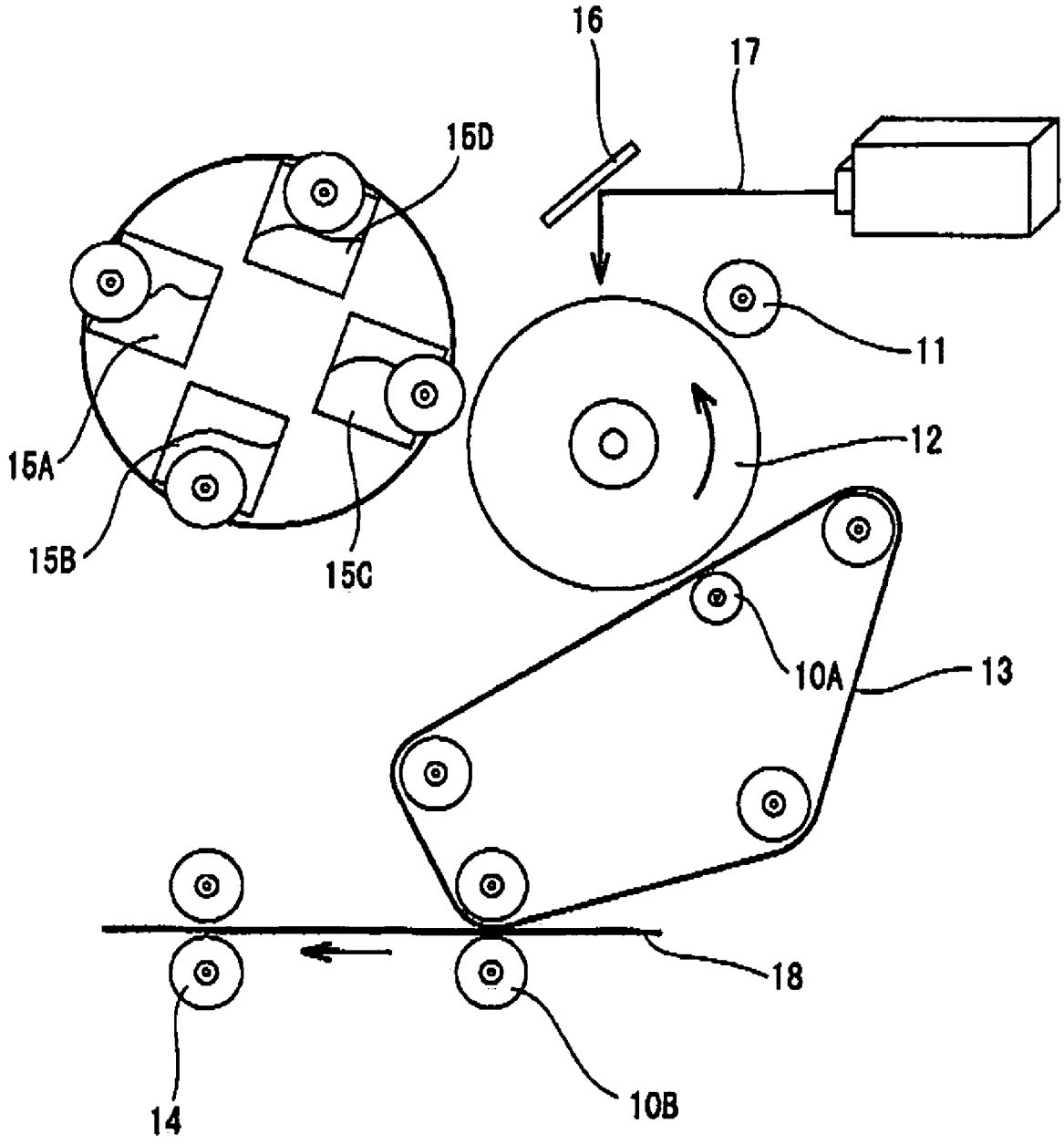
FIG. 2 is an illustrative front view showing a color image-forming apparatus.

In forming an image by the color image-forming apparatus, initially, the photosensitive member 12 rotates in the direction shown with the arrow of FIG. 2. After the photosensitive member 12 is charged by the charging roller 11, a laser 17 exposes a non-imaging portion of the photosensitive member 12 via the mirror 16. As a result, the non-imaging portion is destaticized. The portion of the photosensitive member 12 corresponding to an imaging portion is charged. Thereafter the toner 15A is supplied to the photosensitive member 12 and attaches to the charged imaging portion to form a first-color toner image. An electric field is applied to the primary transfer roller 10A to transfer the toner image to the intermediate transfer belt 13. In the same manner, a toner image of each of the other toners 15B to 15D formed on the photosensitive member 12 is transferred to the intermediate transfer belt 13. A full-color image composed of the four-color toners 15A through 15D is formed on the intermediate transfer belt 13. An electric field is applied to the secondary transfer roller 10B to transfer the full-color image to a to-be-transferred material (normally, paper) 18. When the to-be-transferred material 18 passes between a pair of the fixing rollers 14 heated to a predetermined temperature, the full-color image is transferred to the surface thereof. In performing double-side printing, the paper 18 or the like that has passed the fixing roller 14 is inverted inside the printer. Then the above-described image-forming processes are repeated. Thereby an image is formed on the rear surface of the paper 18.

As an image-forming apparatus using the conductive roller of the present invention, a monochromatic printer having a construction using not an intermediate transfer belt but a transfer roller is described below with reference to FIG. 3. A monochromatic printer to which the conductive roller of the present invention is applied has a transfer roller 10, a charging roller 21, a photosensitive member 22, a fixing roller 24, toner 25, and a mirror 26.

Figure 3:
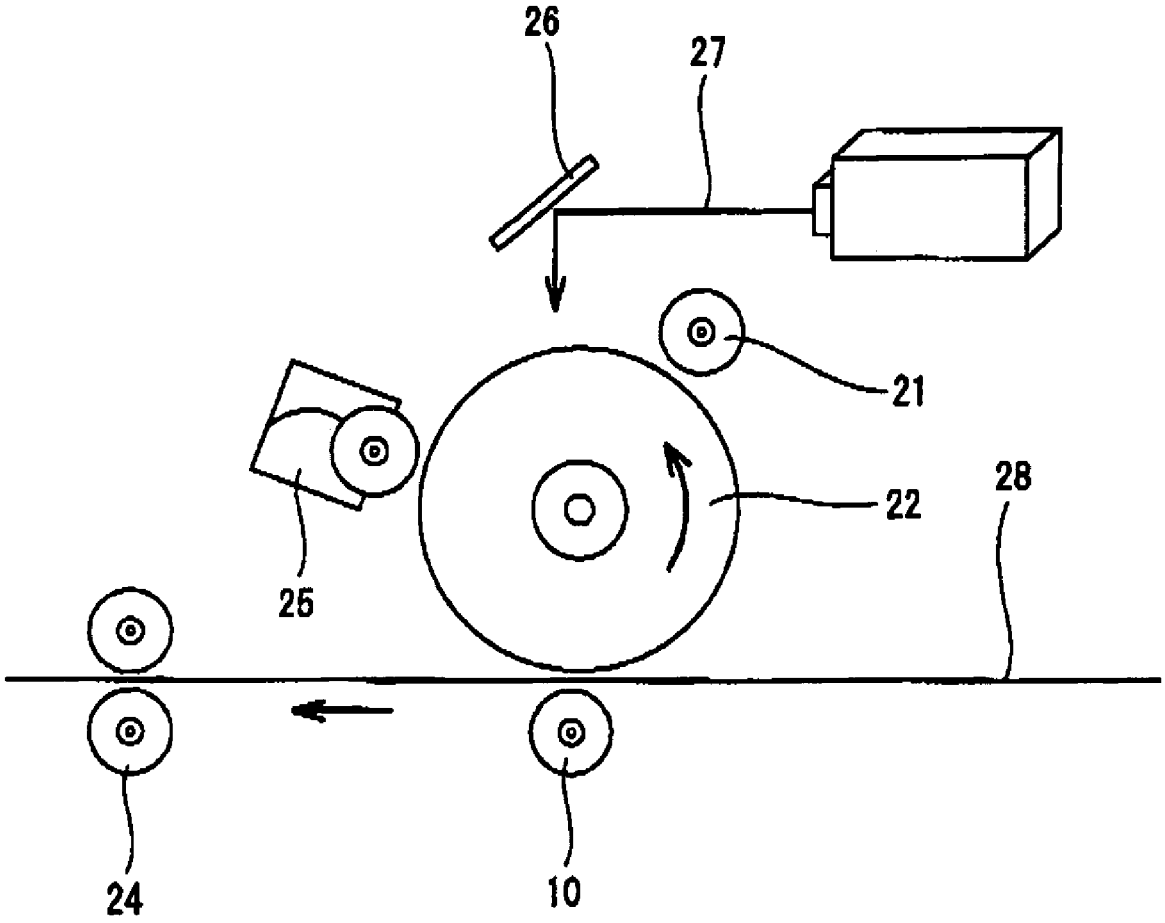
FIG. 3 is an illustrative front view showing a monochromatic image-forming apparatus.

In forming an image by a monochromatic image-forming apparatus, initially, the photosensitive member 22 rotates in the direction shown with the arrow of FIG. 3. After the photosensitive member 22 is charged by the charging roller 21, a laser 27 exposes the photosensitive member 22 via the mirror 26. Thereafter the toner 25 is supplied to the photosensitive member 22 to develop a toner image. Then the toner image formed on the photosensitive member 22 rotates together with the photosensitive member 22 and is transferred to paper 28 which passes between the photosensitive member 22 and the transfer roller 10. Thereafter the paper 28 is transported to the fixing roller 24 in the direction shown with the arrow of FIG. 3 to fix the toner image to the paper 28. In performing double-side printing, the paper 28 or the like that has passed the fixing roller 14 is inverted inside the printer. Then the above-described image-forming processes are repeated. Thereby an image is formed on the rear surface of the paper 28. As described above, the conductive roller of the present invention can be used for image-forming apparatuses such as a copying apparatus, a printer, a facsimile, and the like.

In addition to the above-described polymers not containing chlorine nor bromine, the following polymers containing the polyether can be used as the polymer not containing chlorine nor bromine: ethylene oxide-propylene oxide-allyl glycidyl ether copolymer, urethane rubber, and the like. As the polymer having the cyano group, in addition to the NBR, it is possible to use, hydrogenated acrylonitrile butadiene rubber, carboxyl-modified acrylonitrile butadiene rubber, acrylonitrile butadiene isoprene terpolymer (NBIR), and liquid nitrile rubber. It is possible to select one or more ozone-resistant rubbers from among ethylene propylene rubber (EPM), styrene-butadiene copolymer rubber (SBR), butyl rubber (IIR), and silicone rubber (Q). The low polar ozone-resistant rubber may be mixed carbon black without the master batch.

As the anion-containing salt having the fluoro group and the sulfonyl group, it is possible to use at least one salt selected from among a salt of fluoroalkylsulfonic acid, and a salt of tris(fluoroalkylsulfonyl)methide. The kind of the components and the mixing amount can be appropriately set to optimize the various electrical characteristics of the conductive roller.

Examples of the conductive roller of the present invention and comparison examples will be described in detail below.

The conductive roller of each of the examples and the comparison examples was formed by a conventional method. That is, kneading, extrusion, vulcanization, and molding, and polishing are performed. Thereby the conductive roller of each of the examples and comparison examples was formed. Each conductive roller had a roller outer diameter of ϕ16 mm and an axial length of 305 mm. More specifically, after the components shown in table 1 supplied to a kneader were kneaded at 80° C. for three to five minutes, the mixture was tubularly extruded from the kneader to obtain a preform. After the preform was vulcanized at 160° C. for 10 to 70 minutes, an iron shaft (SUM−24 L) (ϕ8 mm) was inserted into the hollow portion of the tube. After the surface of the tube was polished, the tube was cut to a predetermined size to obtain the conductive roller of each of the examples and the comparison examples. The vulcanizing time period should be set by using a vulcanization testing rheometer (for example, Curast meter). To suppress the stain of the photosensitive member and reduce the compression set, it is preferable to set the vulcanization temperature and the vulcanization time period so that sufficient vulcanization can be accomplished.

TABLE 1-1

| Components | CE1 phr | CE2 phr | CE3 phr | CE4 phr |
|---|---|---|---|---|
| EPDM (trade name: EPT 4045, Mitsui Kagaku) | | 100 | 30 | 100 |
| Filler (carbon black, trade name: Sheast 3, Tokai Carbon) | 10 | 30 | 10 | 10 |
| NBR (trade name: N250S, JSR) | 70 | | 70 | |
| Lithium-bis(trifluoromethanesulfonyl)imide | | | | 1 |
| Epichlorohidrin rubber (trade name: CG102, Daiso) | 30 | | | |
| Ethylene oxide-polypropylene oxide-allyl glycidyl ether terpolymer (ZSN8030, Nippon Zeon) | | | | |
| Vulcanizing assistant (stearic acid, Unikema Australia) | 1 | 1 | 1 | 1 |
| Vulcanizing assistant (zinc oxide, Toho Aen) | 5 | 5 | 5 | 5 |
| Foaming agent OBSH (Nelcelbon, Eiwa Kasei Kogyo) | | 5 | 5 | 5 |
| Foaming agent ADCA (Vinyhall, Eiwa Kasei Kogyo) | 6 | | | |
| Foaming assistant (Cell paste, Eiwa Kasei Kogyo) | 6 | | | |
| Vulcanizing agent (powdered sulfur, Tsurumi Kagaku Kogyo) | 1.0 | 1.0 | 1.0 | 1.0 |
| Accelerator 1 (Knockseller DM, Ouchi Shinko Kagaku Kogyo) | 1.0 | 1.0 | 1.0 | 1.0 |
| Accelerator 2 (Knockseller TS, Ouchi Shinko Kagaku Kogyo) | 0.5 | 0.5 | 0.5 | 0.5 |
| Accelerator 3 (Dixyl peroxide, Parkmill D, Nippon Yushi) | | | | |
| Total | 130.5 | 143.5 | 123.5 | 124.5 |

where CE denotes comparison example.

TABLE 1-2

| Components | E1 phr | E2 phr | E3 phr | E4 phr | E5 phr |
|---|---|---|---|---|---|
| EPDM(trade name: EPT 4045, Mitsui Kagaku) | 30 | 30 | 30 | 30 | 45 |
| Filler(carbon black, trade name: Sheast 3, Tokai Carbon) | 10 | 10 | 5 | 15 | 10 |
| NBR(trade name: N250S, JSR) | 70 | 70 | 70 | 70 | 55 |
| Lithium-bis(trifluoromethanesulfonyl)imide | 0.6 | 1.0 | 2.5 | 1.5 | 5 |
| Epichlorohidrin rubber(trade name: CG102, Daiso) | | | | | |
| Ethylene oxide-polypropylene oxide-allyl glycidyl ether terpolymer(ZSN8030, Nippon Zeon) | 9.4 | 9.0 | | 8.5 | |
| Vulcanizing assistant(stearic acid, Unikema Australia) | 1 | 1 | 1 | 1 | 1 |
| Vulcanizing assistant(zinc oxide, Toho Aen) | 5 | 5 | 5 | 5 | 5 |
| Foaming agent OBSH(Nelcelbon, Eiwa Kasei Kogyo) | 5 | 5 | 5 | | |
| Foaming agent ADCA(Vinyhall, Eiwa Kasei Kogyo) | | | | 6 | |
| Foaming assistant(Cell paste, Eiwa Kasei Kogyo) | | | | 6 | |

TABLE 1-2-continued

| Components | E1 phr | E2 phr | E3 phr | E4 phr | E5 phr |
|---|---|---|---|---|---|
| Vulcanizing agent(powdered sulfur, Tsurumi Kagaku Kogyo) | 1.0 | 1.0 | 1.0 | 1.0 | 1.0 |
| Accelerator 1(Knockseller DM, Ouchi Shinko Kagaku Kogyo) | 1.0 | 1.0 | 1.0 | 1.0 | 1.0 |
| Accelerator 2(Knockseller TS, Ouchi Shinko Kagaku Kogyo) | 0.5 | 0.5 | 0.5 | | 0.5 |
| Accelerator 3(Dixyl peroxide, Parkmill D, Nippon Yushi) | | | | 1.0 | |
| Total | 133.5 | 133.5 | 121.0 | 145.0 | 123.5 |

where E denotes example.

EXAMPLES 1 THROUGH 5

The conductive elastic layer was formed by using a polymer composition containing the polymer not containing chlorine nor bromine as its main component; and the anion-containing salt having the fluoro group and the sulfonyl group. As the polymer not containing chlorine nor bromine, the NBR having the cyano group was used and the ethylene oxide-propylene oxide-allyl glycidyl ether terpolymer (EO:PO:AGE=90:4:6) which is a polyether polymer and the EPDM which is a low-polar ozone-resistant rubber were used as necessary. Lithium-bis(trifluoromethanesulfonyl) imide was used as the anion-containing salt having the fluoro group and the sulfonyl group. The lithium-bis(trifluoromethanesulfonyl)imide was synthesized by the conventional method described in Japanese Patent Application Laid-Open No. 2001-288193. The anion-containing salt having the fluoro group and the sulfonyl group was added to the polymer component without the intermediary of a medium, not fixed by crosslinking, which consists of the low molecular weight (not more than 10000) polyether compound or the low molecular weight polar compound. Other components shown in table 1 were used in the amount shown therein.

COMPARISON EXAMPLE 1

As the main components of the conductive roller of the comparison example 1, 70 parts by weight of the NBR and 30 parts by weight of epichlorohidrin rubber (GECO, ethylene oxide:epichlorohidrin:allyl glycidyl ether=56:40:4) were used. The anion-containing salt having the fluoro group and the sulfonyl group was not used. Other components shown in table 1 were used in the amount shown therein.

COMPARISON EXAMPLE 2

As the polymer component, 100 parts by weight of the EPDM was used. The anion-containing salt having the fluoro group and the sulfonyl group was not used, but carbon black was used to obtain a necessary electric conduction. The polymer having the cyano group was not used either. Other components shown in table 1 were used in the amount shown therein.

COMPARISON EXAMPLE 3

As the polymer component, 70 parts by weight of the NBR and 30 parts by weight of the EPDM were used. The anion-containing salt having the fluoro group and the sulfonyl group was not used. Other components shown in table 1 were used in the amount shown therein.

COMPARISON EXAMPLE 4

As the polymer component, 100 parts by weight of the EPDM was used. The anion-containing salt having the fluoro group and the sulfonyl group was used. The polymer having the polyether or/and the cyano group was not used. Other components shown in table 1 were used in the amount shown therein.

The following evaluations of the conductive roller of each of the examples and the comparison examples were made by methods which will be described later.

TABLE 2

| | CE1 | CE2 | CE3 | CE4 | E1 | E2 | E3 | E4 | E5 |
|---|---|---|---|---|---|---|---|---|---|
| Hardness(Durometer Type E) | 33 | 29 | 31 | 28 | 32 | 30 | 33 | 35 | 62 |
| Resistance(logΩ) | 8.0 | 7.9 | 8.0 | 10.9 | 8.3 | 7.8 | 6.1 | 7.4 | 7.3 |
| Peripheral nonuniformity(Rmax/Rmin) | 1.20 | 2.10 | 1.20 | 1.80 | 1.05 | 1.10 | 1.14 | 1.16 | 1.30 |
| Dependence on environment(LL-HH) Δ (logΩ) | 2.0 | 0.3 | 1.5 | 0.5 | 1.0 | 1.1 | 1.2 | 0.8 | 1.0 |
| Dependence on voltage(100 to 5000 V) Δ (logΩ) | 0.3 | 2.2 | 0.3 | 4.5 | 0.2 | 0.1 | 0.2 | 0.4 | 0.2 |
| Initial drift(%) $R_{initial}/R_{6\ seconds\ later} \times 100\%$ | 106% | 111% | 111% | 105% | 101% | 104% | 101% | 103% | 105% |
| CS(%) | 22% | 23% | 24% | 14% | 30% | 22% | 21% | 13% | 27% |
| Resistance to ozone | ○ | ○ | ○ | ○ | ○ | ○ | ○ | ○ | ○ |

where CE denotes comparison example and where E denotes example.

Circumferential Nonuniformity of Electric Resistance

Figure 4:
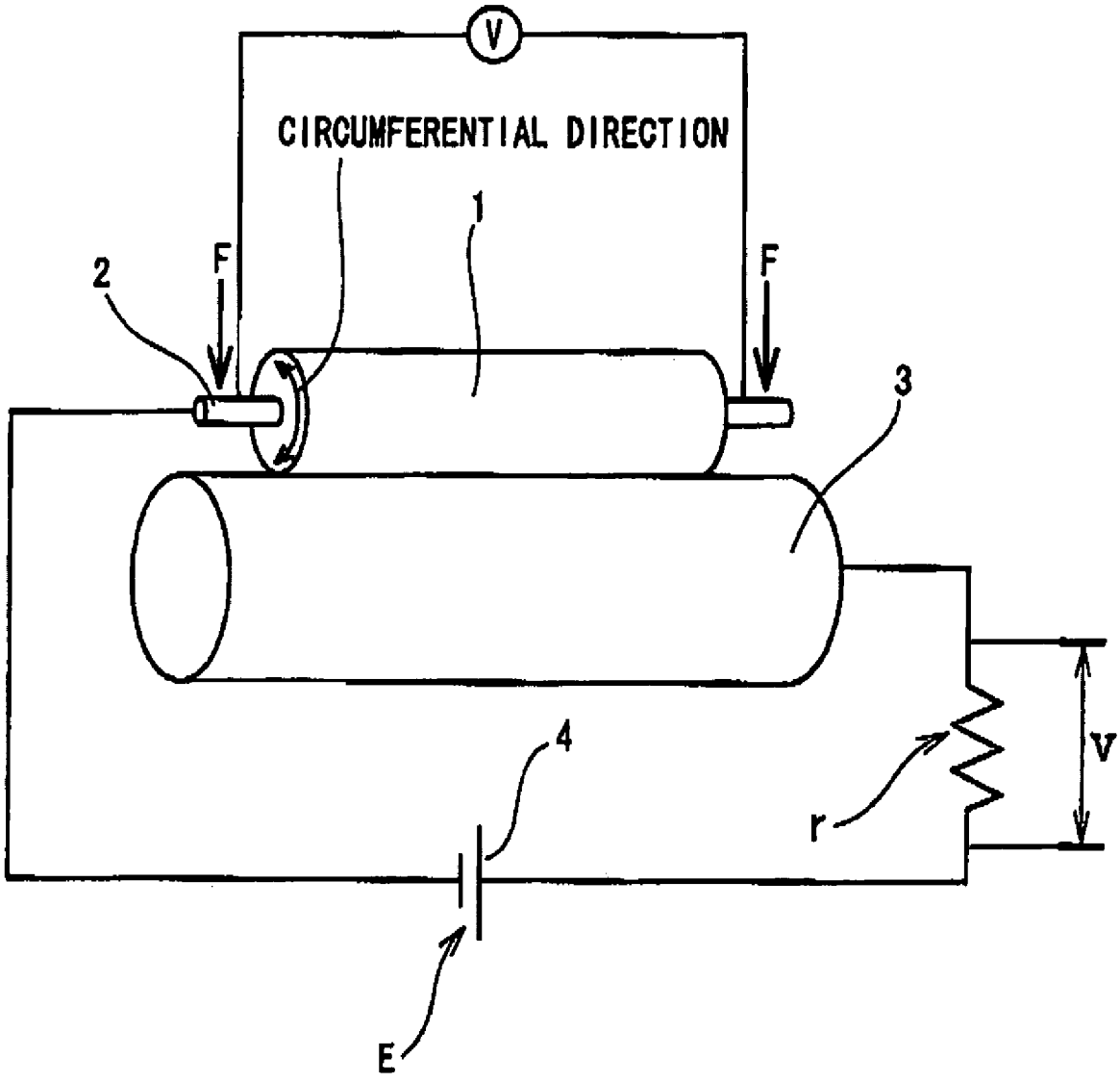
FIG. 4 shows a method of measuring the electric resistance of the conductive roller.

As shown in FIG. 4, at a temperature of 23° C. and a relative humidity of 55%, a conductive elastic layer 1 having a core metal 2 inserted therethrough was mounted on an aluminum drum 3, with the conductive elastic layer 1 in contact with the aluminum drum 3. The leading end of a conductor having an internal electric resistance r (100Ω to 10 kΩ) was connected to the positive side of a power source 4 and to one end surface of the aluminum drum 3. The leading end of another conductor was connected to the negative side of the power source 4 and to one end surface of the conductive elastic layer 1. The value of the internal electric resistance r was adjusted in such a way that the significant digits of a measured value was as large as possible in conformity to the level of the electric resistance value of the conductive roller.

A voltage applied to the internal electric resistance r of the conductor was detected. The detected voltage was set to V.

Supposing that a voltage applied to the apparatus is E, the electric resistance R of the rubber roller 10 is: R=r>×E/(V−r). Because the term of (−r) is regarded as being slight, R=r×E/V.

A load F of 500 g was applied to both ends of the core metal 2. The aluminum drum 3 was rotated at 30 rpm to rotate a conductive roller. While the conductive roller was rotating, a voltage of 1000V was applied between the core metal 2 and the aluminum drum 3 to compute circumferential nonuniformity (maximum electric resistance value in circumferential direction/minimum electric resistance value in circumferential direction) of the electric resistance of the conductive roller.

Measurement of Electric Resistance Value

By using the apparatus shown in FIG. 4, the electric resistance value of the conductive roller was measured by applying a voltage of 1000V thereto at a temperature of 23° C. and a relative humidity of 55%.

The electric resistance value at each of applied voltages 100V and 5000V was measured. The dependence of the electric resistance values on the voltages was evaluated from the difference between common logarithms thereof.

Measurement of Dependence of Electric Resistance Value on Environment

By using the apparatus shown in FIG. 4, the electric resistance value R(Ω) of each conductive roller was measured by applying a voltage of 1000V thereto at a temperature of 10° C. and a relative humidity of 15% and at a temperature of 32.5° C. and a relative humidity of 90%. The dependence of the electric resistance value on environment was computed by using an equation of $\Delta \log_{10}R=\log_{10}R$ (electric resistance value at temperature of 10° C. and relative humidity of 15%)−$\log_{10}R$(electric resistance value at temperature of 32.5° C. and relative humidity of 90%).

Table 2 shows the electric resistance value of each conductive roller and the dependence of each electric resistance value on environment by common logarithm.

Measurement of Initial Drift (Fluctuation of Electric Resistance Value with Time)

The electric resistance value (initial electric resistance value) of each conductive roller at the time when a constant voltage of 1000V was applied thereto at a temperature of 10° C. and a relative humidity of 15% was measured. The electric resistance value (electric resistance value six seconds after start time of successive voltage application) thereof six seconds after the constant voltage of 1000V was applied thereto was measured to compute the ratio of the electric resistance value six seconds after the start time of the voltage application to the initial electric resistance value.

Test of Ozone-Caused Deterioration

Each conductive roller was left 96 hours in a tank in which the temperature was 40° C. and the ozone concentration was 50 pphm to check whether the surface of the conductive roller cracked. The conductive roller which did not crack was marked by O, whereas the conductive roller which cracked was marked by X.

Hardness

The hardness of each conductive roller was tested by using the durometer of type E in conformity to "method of testing hardness of vulcanized rubber and thermoplastic rubber" specified in JIS K6253.

Measurement of Compression Set

The compression set of each conductive roller was measured at a temperature of 70° C. for 24 hours at a compressibility ratio of 25% in accordance with "method of testing permanent strain of vulcanized rubber and thermoplastic rubber" specified in JIS K6262. The sample roller was cut at regular intervals of 10 mm parallel with the axial end surface thereof. The specimen used to measure the compression set was hollow and cylindrical.

As shown in tables 1 and 2, the conductive elastic layer of the conductive roller of the example 1 was composed of the polymer composition including the polymer not containing chlorine nor bromine and containing the cyano group and the anion-containing salt, having the fluoro group and the sulfonyl group, added to the polymer. Therefore the conductive roller is allowed to have a low electric resistance value of $10^{7.7}\Omega$ and a small peripheral nonuniformity value of 1.05, which indicates that the electric resistance of the conductive roller did not have variations in dependence on positions thereof. The conductive roller had a low extent of environment-dependence ($\Delta \log_{10}R$ is 1.0) in its electric resistance. Further the conductive roller had a low extent of dependence ($\Delta \log_{10}R$ is 0.2) on voltage in its electric resistance. That is, the conductive roller had a stable electric resistance value despite variations in environment and voltage. In measurement of the initial drift, the ratio of the electric resistance value six seconds after the start time of the voltage application to the initial electric resistance value was 101%. That is, it was confirmed that the electric resistance value six seconds after the start time of voltage application could be made almost uniform. Further since the conductive roller 10 does not generate toxic smoke when it is burnt, it does not pollute environment because the conductive elastic layer does not contain chlorine nor bromine. It was confirmed that the conductive roller of each of the examples 2 through 5 had very high performance similarly to that of the example 1.

The conductive roller of the comparison example 1 had a high extent of environment-dependence ($\Delta \log_{10}R$ is 2.0) in its electric resistance. Further in measurement of the initial drift, the ratio of the electric resistance value six seconds after the start time of the voltage application to the initial electric resistance value was large, namely, 106%. The conductive roller of the comparison example 2 had a large peripheral nonuniformity of 2.1 and a high extent of dependence ($\Delta \log_{10}R$ is 2.2) on voltage in its electric resistance. In measurement of the initial drift, the ratio of the electric resistance value six seconds after the start time of the voltage application to the initial electric resistance value was large, namely, 111%. The conductive roller of the comparison example 3 had a high electric resistance value of $10^{9.8}\Omega$. In measurement of the initial drift, the ratio of the electric resistance value six seconds after the start time of the voltage application to the initial electric resistance value was large, namely, 111%. The conductive roller of the comparison example 4 had a very high electric resistance value and a large peripheral nonuniformity value of 1.80.

As apparent from the foregoing description, according to the conductive roller of the present invention, the addition of the anion-containing salt having the fluoro group and the sulfonyl group to the polymer allows the conductive roller to have a low electric resistance efficiently. Thus by appropriately adjusting the mixing amount and kind of the polymer not containing chlorine nor bromine, the conductive roller is allowed to have a low electric resistance value and a low extent of dependence on environment in its electric resistance and small variations with time in its electric resistance;

and have small variations in its electric resistance independent of positions thereof. Thereby it is possible to form an image preferably and reliably. Further since the conductive roller does not generate toxic smoke when it is burnt, it does not pollute environment.

Therefore, in the conductive roller, the electric resistance value of the conductive roller measured by applying a voltage of 1000V thereto is not less than $10^4\Omega$ nor more than $10^9\Omega$. When the voltage of 1000V is applied to the conductive roller, the ratio of the maximum value of the electric resistance of the conductive roller in the circumferential direction thereof to the minimum value of the electric resistance thereof is not more than 1.3. When the electric resistance value R(Ω) of the conductive roller is measured at a temperature of 10° C. and a relative humidity of 15% and at a temperature of 32.5° C. and a relative humidity of 90% by applying the voltage of 1000V thereto, the value of the equation of $\Delta \log_{10}R=\log_{10}R$ (electric resistance value at temperature of 10° C. and relative humidity of 15%)$-\log_{10}R$ (electric resistance value at temperature of 32.5° C. and relative humidity of 90%) is not more than 1.4. The difference between the common logarithm of the electric resistance value of the conductive roller measured by applying a voltage of 100V thereto at a temperature of 23° C. and a relative humidity of 55% and the common logarithm of the electric resistance value measured by applying a voltage of 5000V thereto at a temperature of 23° C. and a relative humidity of 55% is not more than 0.5. The ratio of the electric resistance value of the conductive roller six seconds after a voltage is applied thereto to the electric resistance value thereof at a time when the voltage is applied thereto at a temperature of 10° C. and a relative humidity of 15% is not less than 100% nor more than 105%. Therefore the conductive roller of the present invention is stable in its electrical performance and superior in practical use.

In the polymer composition, as the polymer not containing chlorine nor bromine, the polymer containing the polyether or/and the cyano group and the low polar ozone-resistant rubber is used in combination. Further the polymer composition contains carbon black. The carbon black is mixed with the low polar ozone-resistant rubber serving as the master batch for the carbon black. Thereby it is possible to obtain preferable processability and reduce the degree of dependence of the electric resistance value on environment.

Thereby the conductive roller can be suitably used as a charging roller, a developing roller, a transfer roller, and a toner supply roller for use in image-forming apparatuses such as a copying machine, a laser beam printer, a facsimile, an ATM, and the like. The conductive roller of the present invention has a low degree of dependence on environment in its electric resistance. Thus image-forming apparatuses such as the copying machine, the printer, the facsimile, and the like do not require a large power unit and hence has a low power consumption. Further the conductive roller can be used in a control system having a simple construction. Furthermore it is possible to reduce the number of operation tests in different temperatures and humidities and reduce the period of time required and the cost for development.

The second embodiment of the present invention is described below.

The second embodiment is different from the first embodiment in that the polymer composition of a conductive elastic layer 1' contains 100 parts by weight of a mixture of 30 parts by weight of the EPDM and 70 parts by weight of the NBR both not containing chlorine nor bromine; not less than 0.01 nor more than 20 parts by weight of the anion-containing salt having the fluoro group and the sulfonyl group; and a chemical foaming agent. As the anion-containing salt having the fluoro group and the sulfonyl group, a salt of bisfluoroalkylsulfonyl imide and/or a salt of fluoroalkylsulfonic acid and/or a salt of tris(fluoroalkylsulfonyl)methide are used. More specifically, as the anion-containing salt having the fluoro group and the sulfonyl group, lithium-bis(trifluoromethanesulfonyl)imide and/or lithium trifluoromethanesulfonate and/or lithium tris(trifluoromethanesulfonyl)methide are used. As the chemical foaming agent, ADCA and/or OBSH are used. As the foaming assistant, urea is used as necessary.

The following agents are added in a necessary amount to the rubber component: A vulcanizing agent (sulfur and/or dicumyl peroxide), a vulcanizing accelerator (dibenzothiazolyl disulfide and tetramethylthiuram monosulfide), an inorganic filler (soft calcium carbonate), and zinc oxide are used in a necessary amount respectively. The rubber composition did not contain the halogen.

After the rubber composition is kneaded, it is extruded cylindrically by an extruder to preform it. The obtained preform is cut to a predetermined size. The preform is supplied to a vulcanizing can of a pressure/water vapor type. In the vulcanizing can, the chemical foaming agent gasifies and foams, and the rubber component is vulcanized at a rubber component-crosslinking temperature.

The chemical foaming agent is added to the rubber component to make the rubber composition sponge-like. Thereby the conductive roller has a hardness not more than 40, when the hardness was measured by the durometer of type E specified in JIS K6253. The conductive roller has an electric resistance value not more than $10^9\Omega$ and a compression set not more than 30, when a voltage of 1 kV thereto is applied thereto.

The conductive roller 10' contains not less than 0.01 nor more than 20 parts by weight of the anion-containing salt, having the fluoro group and the sulfonyl group, added to 100 parts by weight of the mixture of the EPDM and the NBR; and the chemical foaming agent. Therefore the conductive roller 10' does not contain chlorine nor bromine and has its electric resistance adjusted easily and superior properties (low compression set and hardness). Accordingly the conductive roller 10' can be suitably used as a developing roller, a charging roller, a transfer roller, and the like for use in electrophotographic apparatuses such as a copying machine, facsimile, and a printer.

Similarly to the first embodiment, it is possible to apply the conductive roller 10' of the present invention to the color printer, shown in FIG. 2, having the intermediate transfer belt.

Similarly to the first embodiment, it is possible to apply the conductive roller 10' of the present invention to the monochromatic printer, shown in FIG. 3, having the construction using not the intermediate transfer belt but the transfer roller.

It is possible to use the salt of bisfluoroalkylsulfonyl imide, the salt of fluoroalkylsulfonic acid, and the salt of tris(fluoroalkylsulfonyl)methide singly or in combination. The anion-containing salt having the fluoro group and the sulfonyl group is added to the rubber component without the intermediary of a medium selected from among low molecular weight polyether compounds whose molecular weight is not more than 10000 and low-molecular-weight polar compounds whose molecular weight is not more than 10000. As the chemical foaming agent, azodicarbonamide (ADCA) and 4,4'-oxybis (benzene sulfonyl hydrazide) (OBSH) are used singly or in combination. The kind of the components and the mixing amount can be appropriately set.

Examples 6 through 17 of the conductive roller of the present invention and comparison examples 5 through 7 will be described in detail below.

The conductive roller of each of the examples 6 through 17 and the comparison examples 5 through 7 was formed by using a conventional method. That is, kneading, extrusion, vulcanization, and molding, and polishing were performed. Thereby the foamed conductive roller of each of the examples and comparison examples was formed. More specifically, after the components shown in table 3 supplied to a kneader were kneaded for one to 20 minutes. Thereafter the unvulcanized rubber composition was taken out of the kneader. The unvulcanized rubber composition was taken in the form of a ribbon by using an open roll. The unvulcanized rubber composition was tubularly extruded with a mono-axial extruder to obtain a preform. After the preform was vulcanized at 160° C. for 30 minutes, an iron shaft (ϕ6 mm) was inserted into the hollow portion of the tube. After the surface of the tube was polished, the tube was cut to a predetermined size to obtain the conductive foamed roller (outer diameter: ϕ15 mm, length: 230 mm) of each of the examples and the comparison examples. The following tests were conducted for the conductive foamed roller of each of the examples and the comparison examples. Table 3 shows the results.

TABLE 3-1

| Components | Trade name, name of compounds | Maker | Example 6 | Example 7 | Example 8 | Example 9 | Notes |
|---|---|---|---|---|---|---|---|
| NBR | Nippol 401LL | Nippon Zeon | 70 | 70 | 70 | 70 | |
| EPDM | EPT4045 | Mitsui Kagaku | 30 | 30 | 30 | 30 | |
| PEO + PPO + AGE terpolymer | ZSN8030 | Nippon Zeon | | | | | |
| High-performance ionic-conductive addition salt 1 | Lithium-bis (trifluoromethanesulfonyl) imide | | 0.1 | 0.5 | 10 | 20 | |
| High-performance ionic-conductive addition salt 2 | Lithium trifluoromethanesulfonate | | | | | | |
| High-performance ionic-conductive addition salt 3 | Lithium tris (trifluoromethanesulfonyl) methide | | | | | | |
| Quaternary ammonium salt not containing chlorine | KP-4729 | Kao | | | | | |
| Ionic-conductive additive 1 | Dibutoxyethoxyethyl adipate + lithium-bis (trifluoromethanesulfonyl) imide | | | | | | |
| Inorganic filler | Soft calcium carbonate | Maruo Calcium | 20 | 20 | 20 | 20 | |
| Zinc oxide | Ginrei R | Toho Aen | 5 | 5 | 5 | 5 | |
| Stearic acid | 4931 | Unikema Australia | 1 | 1 | 1 | 1 | |
| Foaming agent 1 | Neocellbon NT000SW | Eiwa Kasei Kogyo | | | | | |
| Foaming agent 2 | Vinyhall AC#3 | Eiwa Kasei Kogyo | 7.5 | 7.5 | 7.5 | 7.5 | |
| Foaming assistant | Cell paste 101 | Eiwa Kasei Kogyo | 7.5 | 7.5 | 7.5 | 7.5 | |
| Vulcanizing agent 1 | Sulfur | Tsurumi Kagaku Kogyo | 1.5 | 1.5 | 1.5 | 1.5 | |
| Vulcanizing accelerator | DM | Ouchi Shinko Kagaku Kogyo | 1.5 | 1.5 | 1.5 | 1.5 | |
| Vulcanizing accelerator | TS | Ouchi Shinko Kagaku Kogyo | 0.5 | 0.5 | 0.5 | 0.5 | |
| Vulcanizing agent 2 | Dicumyl peroxide | Nippon Yushi | | | | | |
| Hardness | | | 29 | 30 | 32 | 37 | Good roller: below 40 |
| Electric resistance | 1000 V 23° C. 55% | | 8.9 | 7.8 | 5.7 | 5.5 | Good roller: below 9.0 |
| Dependence on environment | 10° 15%–32.5° C. 90% | | 1.2 | 1.1 | 1.2 | 1.3 | |
| Compression set | 70° C. 22 hr 25% | | 15 | 16 | 17 | 18 | Good roller: below 30 |
| Stain of photosensitive member | 32° C. 90% 2 weeks | | ○ | ○ | ○ | ○ | ○: did not stain |
| whether chlorine or bromine is contained | | | Not contained | Not contained | Not contained | Not contained | |
| Ozone test | 70° C. 5 pphm 96 hr 10% | | ○ | ○ | ○ | ○ | |
| Judgement | | | ○ | ○ | ○ | ○ | ○: OK |

TABLE 3-2

| Components | Trade name, name of compounds | Maker | Example 10 | Example 11 | Example 12 | Example 13 | Notes |
|---|---|---|---|---|---|---|---|
| NBR | Nippol 401LL | Nippon Zeon | 70 | 70 | 80 | 50 | |
| EPDM | EPT4045 | Mitsui Kagaku | 30 | 30 | 20 | 50 | |
| PEO + PPO + AGE terpolymer | ZSN8030 | Nippon Zeon | | | | | |
| High-performance ionic-conductive addition salt 1 | Lithium-bis (trifluoromethanesulfonyl) imide | | | | 0.5 | 0.5 | |
| High-performance ionic-conductive addition salt 2 | Lithium trifluoromethanesulfonate | | 0.5 | | | | |
| High-performance ionic-conductive addition salt 3 | Lithium tris (trifluoromethanesulfonyl) methide | | | 0.5 | | | |
| Quaternary ammonium salt not containing chlorine | KP-4729 | Kao | | | | | |
| Ionic-conductive additive 1 | Dibutoxyethoxyethyl adipate + lithium-bis (trifluoromethanesulfonyl) imide | | | | | | |
| Inorganic filler | Soft calcium carbonate | Maruo Calcium | 20 | 20 | 20 | 20 | |
| Zinc oxide | Ginrei R | Toho Aen | 5 | 5 | 5 | 5 | |
| Stearic acid | 4931 | Unikema Australia | 1 | 1 | 1 | 1 | |
| Foaming agent 1 | Neocellbon NT000SW | Eiwa Kasei Kogyo | | | | | |
| Foaming agent 2 | Vinyhall AC#3 | Eiwa Kasei Kogyo | 7.5 | 7.5 | 7.5 | 7.5 | |
| Foaming assistant | Cell paste 101 | Eiwa Kasei Kogyo | 7.5 | 7.5 | 7.5 | 7.5 | |
| Vulcanizing agent 1 | Sulfur | Tsurumi Kagaku Kogyo | 1.5 | 1.5 | 1.5 | 1.5 | |
| Vulcanizing accelerator | DM | Ouchi Shinko Kagaku Kogyo | 1.5 | 1.5 | 1.5 | 1.5 | |
| Vulcanizing accelerator | TS | Ouchi Shinko Kagaku Kogyo | 0.5 | 0.5 | 0.5 | 0.5 | |
| Vulcanizing agent 2 | Dicumyl peroxide | Nippon Yushi | | | | | |
| Hardness | | | 32 | 28 | 28 | 33 | Good roller: below 40 |
| Electric resistance | 1000 V 23° C. 55% | | 8.0 | 7.7 | 8.3 | 7.4 | Good roller: below 9.0 |
| Dependence on environment | 10° C. 15%–32.5° C. 90% | | 1.3 | 0.9 | 0.9 | 1.4 | |
| Compression set | 70° C. 22 hr 25% | | 16 | 16 | 15 | 28 | Good roller: below 30 |
| Stain of photosensitive member | 32° C. 90% 2 weeks | | ○ | ○ | ○ | ○ | ○: did not stain |
| Whether chlorine or bromine is contained | | | Not contained | Not contained | Not contained | Not contained | |
| Ozone test | 70° C. 5 pphm 96 hr 10% | | ○ | ○ | ○ | ○ | |
| Judgement | | | ○ | ○ | ○ | ○ | ○: OK |

TABLE 3-3

| Components | Trade name, name of compounds | Maker | Example 14 | Example 15 | Example 16 | Example 17 | Notes |
|---|---|---|---|---|---|---|---|
| NBR | Nippol 401LL | Nippon Zeon | 50 | 70 | 70 | 70 | |
| EPDM | EPT4045 | Mitsui Kagaku | 50 | 30 | 30 | 30 | |
| PEO + PPO + AGE terpolymer | ZSN8030 | Nippon Zeon | | | | 10 | |
| High-performance ionic-conductive addition salt 1 | Lithium-bis (trifluoromethanesulfonyl) imide | | 0.5 | 0.5 | 0.5 | 1 | |
| High-performance ionic-conductive addition salt 2 | Lithium trifluoromethanesulfonate | | | | | | |
| High-performance ionic-conductive addition salt 3 | Lithium tris (trifluoromethanesulfonyl) methide | | | | | | |

TABLE 3-3-continued

| Components | Trade name, name of compounds | Maker | Example 14 | Example 15 | Example 16 | Example 17 | Notes |
|---|---|---|---|---|---|---|---|
| Quaternary ammonium salt not containing chlorine | KP-4729 | Kao | | | | | |
| Ionic-conductive additive 1 | Dibutoxyethoxyethyl adipate + lithium-bis (trifluoromethanesulfonyl) imide | | | | | | |
| Inorganic filler | Soft calcium carbonate | Maruo Calcium | 20 | 20 | 20 | 20 | |
| Zinc oxide | Ginrei R | Toho Aen | 5 | 5 | 5 | 5 | |
| Stearic acid | 4931 | Unikema Australia | 1 | 1 | 1 | 1 | |
| Foaming agent 1 | Neocellbon NT000SW | Eiwa Kasei Kogyo | | 7.5 | 4 | | |
| Foaming agent 2 | Vinyhall AC#3 | Eiwa Kasei Kogyo | 7.5 | | 4 | 7.5 | |
| Foaming assistant | Cell paste 101 | Eiwa Kasei Kogyo | 7.5 | | 4 | 7.5 | |
| Vulcanizing agent 1 | Sulfur | Tsurumi Kagaku Kogyo | 1 | 1.5 | 1.5 | 1.5 | |
| Vulcanizing accelerator | DM | Ouchi Shinko Kagaku Kogyo | 1 | 1.5 | 1.5 | 1.5 | |
| Vulcanizing accelerator | TS | Ouchi Shinko Kagaku Kogyo | | 0.5 | 0.5 | 0.5 | |
| Vulcanizing agent 2 | Dicumyl peroxide | Nippon Yushi | 1 | | | | |
| Hardness | | | 35 | 34 | 33 | 31 | Good roller: below 40 |
| Electric resistance | 1000 V 23° C. 55% | | 7.6 | 7.8 | 7.7 | 7.8 | Good roller: below 9.0 |
| Dependence on environment | 10° C. 15%–32.5° C. 90% | | 1.4 | 1.0 | 1.1 | 1.0 | |
| Compression set | 70° C. 22 hr 25% | | 20 | 18 | 17 | 18 | Good roller: below 30 |
| Stain of photosensitive member | 32° C. 90% 2 weeks | | ○ | ○ | ○ | ○ | ○: did not stain |
| Whether chlorine or bromine is contained | | | Not contained | Not contained | Not contained | Not contained | |
| Ozone test | 70° C. 5 pphm 96 hr 10% | | ○ | ○ | ○ | ○ | |
| Judgement | | | ○ | ○ | ○ | ○ | ○: OK |

TABLE 3-4

| Components | Trade name, name of compounds | Maker | Comparison Example 5 | Comparison Example 6 | Comparison Example 7 | Notes |
|---|---|---|---|---|---|---|
| NBR | Nippol 401LL | Nippon Zeon | 70 | 70 | 70 | |
| EPDM | EPT4045 | Mitsui Kagaku | 30 | 30 | 30 | |
| PEO + PPO + AGE terpolymer | ZSN8030 | Nippon Zeon | | 10 | 10 | |
| High-performance ionic-conductive addition salt 1 | Lithium-bis (trifluoromethanesulfonyl) imide | | | | | |
| High-performance ionic-conductive addition salt 2 | Lithium trifluoromethanesulfonate | | | | | |
| High-performance ionic-conductive addition salt 3 | Lithium tris (trifluoromethanesulfonyl) methide | | | | | |
| Quaternary ammonium salt not containing chlorine | KP-4729 | Kao | | 5 | | |
| Ionic-conductive additive 1 | Dibutoxyethoxyethyl adipate + lithium-bis (trifluoromethanesulfonyl) imide | | | | 5 | |
| Inorganic filler | Soft calcium carbonate | Maruo Calcium | 20 | 20 | 20 | |
| Zinc oxide | Ginrei R | Toho Aen | 5 | 5 | 5 | |
| Stearic acid | 4931 | Unikema Australia | 1 | 1 | 1 | |
| Foaming agent 1 | Neocellbon NT000SW | Eiwa Kasei Kogyo | | | | |
| Foaming agent 2 | Vinyhall AC#3 | Eiwa Kasei Kogyo | 7.5 | 7.5 | 7.5 | |
| Foaming assistant | Cell paste 101 | Eiwa Kasei Kogyo | 7.5 | 7.5 | 7.5 | |

TABLE 3-4-continued

| Components | Trade name, name of compounds | Maker | Comparison Example 5 | Comparison Example 6 | Comparison Example 7 | Notes |
|---|---|---|---|---|---|---|
| Vulcanizing agent 1 | Sulfur | Tsurumi Kagaku Kogyo | 1.5 | 1.5 | 1.5 | |
| Vulcanizing accelerator | DM | Ouchi Shinko Kagaku Kogyo | 1.5 | 1.5 | 1.5 | |
| Vulcanizing accelerator | TS | Ouchi Shinko Kagaku Kogyo | 0.5 | 0.5 | 0.5 | |
| Vulcanizing agent 2 | Dicumyl peroxide | Nippon Yushi | | | | |
| Hardness | | | 28 | 36 | 27 | Good roller: below 40 |
| Electric resistance | 1000 V 23° C. 55% | | 9.8 | 8.3 | 6.2 | Good roller: below 9.0 |
| Dependence on environment | 10° C. 15%–32.5° C. 90% | | 1.5 | 1.4 | 0.7 | |
| Compression set | 70° C. 22 hr 25% | | 20 | 8 | 31 | Good roller: below 30 |
| Stain of photosensitive member | 32° C. 90% 2 weeks | | ○ | X | X | ○: did not stain X: stained |
| Whether chlorine or bromine is contained | | | Not contained | Not contained | Not contained | |
| Ozone test | 70° C. 5 pphm 96 hr 10% | | ○ | ○ | ○ | |
| Judgement | | | X | X | X | X: No Good |

In each table, the mixing ratio of each component is shown by part by weight. The abbreviation DM denotes dibenzothiazolyl disulfide, and TS denotes tetramethylthiuram monosulfide. As the foaming agent 1, OBSH (4,4'-oxybis(benzene sulfonyl hydrazide) was used. As the foaming agent 2, ADCA was used. Cell paste 101 shown in table 3 as the foaming assistant is urea. As the NBR, low-nitrile NBR having an acrylonitrile amount (central value) of 18.0% was used.

In table 3, as the high-performance ionic-conductive addition salt 1 which is the anion-containing salt having the fluoro group and the sulfonyl group, the lithium-bis(trifluoromethanesulfonyl)imide was used. As the high-performance ionic-conductive addition salt 2, the lithium trifluoromethanesulfonate was used. As the high-performance ionic-conductive addition salt 3, the lithium tris(trifluoromethanesulfonyl)methide was used.

As the quaternary ammonium salt not containing chlorine, KP4729 (M–: anions of gluconic acid, produced by Kao Inc.), shown in table 3, having the structure shown by chemical formula 1 was used for the conductive foamed roller of the comparison example 6.

Chemical Formula 1

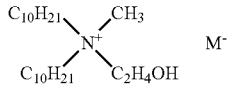

The ionic-conductive additive used for the conductive foamed roller of the comparison example 7 consisted of 20 wt % of lithium-bis(trifluoromethanesulfonyl)imide dissolved in dibutoxyethoxyethyl adipate.

EXAMPLES 6 THROUGH 17

The conductive foamed roller of each of the examples 6 through 17 contained 100 parts by weight of the mixture of EPDM and NBR; 0.01 parts by weight to 20 parts by weight of the anion-containing salt, having the fluoro group and the sulfonyl group, added to the mixture of the EPDM and the NBR; the chemical foaming agent consisting of ADCA and/or OBSH; and the foaming assistant consisting of urea used as necessary.

COMPARISON EXAMPLES 5 Through 7

The conductive foamed roller of the comparison example 5 was composed of a rubber composition out of the scope of the present invention in that the anion-containing salt having the fluoro group and the sulfonyl group was not used. The conductive foamed roller of the comparison example 6 was composed of a rubber composition out of the scope of the present invention in that KP4729 produced by Kao Inc. which is the quaternary ammonium salt not containing chlorine was used instead of the anion-containing salt having the fluoro group and the sulfonyl group. The compression set of the conductive foamed roller of the comparison example 7 was out of the scope of the present invention in its compression set in that the lithium-bis(trifluoromethanesulfonyl)imide was not used as the anion-containing salt having the fluoro group and the sulfonyl group, but the dibutoxyethoxyethyl adipate which is a low molecular weight compound having the ether structure was used as the dispersing medium.

The electric resistance value, dependence of the electric resistance on environment, hardness, and compression set were measured, and the ozone-caused deterioration test of the conductive foamed roller of each of the examples and the comparison examples was conducted in a method similar to the above-described method. Regarding the test of stain of the photosensitive member, whether conductive roller contains chlorine or bromine, and judgement, the following characteristics were measured. The results are shown in the lower portion of table 3.

Measurement of Stain of Photosensitive Member

Stain of Photosensitive Roller

Each conductive foamed roller was left for two weeks at 32.5° C. and 90% RH, with each conductive roller pressed at a load of 500 g against the photosensitive member set in a cartridge (cartridge type C4127X) of a laser beam printer of Laser Jet 4050 type produced by Hulet Packard Inc. Whether the surface of the photosensitive member was stained was visually inspected. The conductive roller which did not stain the photosensitive member was marked by O, whereas the conductive roller which stained the photosensitive member was marked by X.

Whether Conductive Roller Contains Chlorine or Bromine

Conductive foamed rollers that contained chlorine or bromine are marked by "contained", whereas those not containing chlorine or bromine are marked by "not contained".

Judgement

Based on the results of the tests, conductive foamed rollers judged that they can be practically used were marked by O, whereas those judged that they cannot be practically used were marked by X, as shown in table 3.

As shown in table 3, the conductive foamed roller of each of the examples 6 through 17 was preferable in that the value of the common logarithm of the electric resistance value thereof was below nine, and the compression set thereof was below 30. Since they did not stain the photosensitive member, they were all marked by O. The hardness thereof was all low, namely, less than 40 respectively.

It could be confirmed that the conductive foamed roller of each of the examples 6 through 17 can be adjusted to not more than $10^9$ in the electric resistance value thereof, did not stain the photosensitive member, and had a low hardness.

The conductive foamed roller of each of the examples 6 through 17 did not contain chlorine nor bromine. Thus in burning the conductive rollers to discard them, there is no fear that they generate toxic smoke such as hydrogen chloride, hydrogen bromide, dioxin, and the like and toxic substances. Therefore the conductive rollers do not pollute environment.

The conductive foamed roller of each of the examples 6 through 17 contained a large amount of the anion-containing salt having the fluoro group and the sulfonyl group in the range specified in the present invention. Therefore each of them had a low compression set, did not stain the photosensitive member, had a low hardness, and had a low electric resistance value.

The conductive foamed roller of the comparison example 5 did not contain the anion-containing salt having the fluoro group and the sulfonyl group. Therefore the electric resistance value of the conductive foamed roller was more than $10^9$. Further the conductive foamed roller had a high extent of dependence on environment in its electric resistance.

The conductive foamed roller of the comparison example 6 contained the quaternary ammonium salt instead of the anion-containing salt having the fluoro group and the sulfonyl group. Therefore to obtain a desired electric resistance value, it was necessary to use a large amount of the quaternary ammonium salt. Thus the conductive foamed roller stained the photosensitive member.

The conductive foamed roller of the comparison example 7 contained the low molecular weight compound as the dispersing medium. Therefore it had a high compression set and stained the photosensitive member.

As apparent from the foregoing description, according to the present invention, the addition of the chemical foaming agent to the rubber component allows the rubber composition to be sponge-like and allows the conductive foamed roller to have an effective hardness as a transfer roller which requires a proper nip width. The anion-containing salt having the fluoro group and the sulfonyl group is capable of greatly reducing the electric resistance of the conductive foamed roller without deteriorating other properties thereof, by adding a small amount thereof to the rubber component.

Since the conductive roller contains the rubber component containing the mixture of the EPDM and the NBR, the conductive elastic layer is resistant to ozone. Since the conductive elastic layer does not contain the halogen component such as chlorine nor bromine, the halogen component does not make a secondary reaction. Further it is possible to realize the reduction of the compression set and the electric resistance value of the conductive roller. Thus in burning the conductive roller to discard it, there is no fear that it generates toxic smoke such as hydrogen chloride, dioxin, and the like. Therefore the conductive roller of the present invention does not pollute environment.

Therefore the conductive foamed roller of the present invention can be suitably used for the conductive mechanism of electrophotographic apparatuses such as the laser beam printer, the copying machine, the facsimile, the ATM, and the like. More specifically, the conductive foamed roller can be very usefully used as the developing roller for attaching toner to the photosensitive member, the charging roller for uniformly charging the photosensitive drum, the transfer roller for transferring a toner image from the photosensitive member to paper, the toner supply roller for transporting the toner, and the driving roller for driving a transfer belt from the inner side thereof. The conductive roller can be particularly suitably used as the transfer roller because it allows a nip width to be increased, which allows the toner image to be transferred efficiently to paper.

Although the conductive foamed roller of the present invention is ionic-conductive and hence has a low electric resistance value, it has a low degree of dependence on environment in its electric resistance and a low hardness and compression set. Therefore image-forming apparatuses such as the copying apparatus, the printer, and the like using the conductive foamed roller of the present invention provide a uniform image and has a reduced power consumption because the image-forming apparatuses are driven by a small power unit. Further it is possible to simplify the construction of the control system of the image-forming apparatuses and reduce the number of environment tests. Hence it is possible to reduce the period of time and the cost required for development. Further members disposed in the periphery of the conductive roller are given a small burden and the image-forming apparatuses provide images reliably for a long time.

The third embodiment of the present invention will be described below.

The third embodiment is different from the first embodiment in that a conductive elastic layer 1" is formed by foaming a rubber component with a chemical foaming agent.

The rubber composition contains 80 parts by weight of a mixture of acrylonitrile butadiene rubber (NBR) whose bound acrylonitrile amount is 18%, 15 parts by weight of ethylene-propylene-diene terpolymer (EPDM), and five parts by weight of polyethylene oxide (EO)-polypropylene oxide (PO)-allyl glycidyl ether (AGE) terpolymer (AGE); and 1 part by weight of lithium-bis(trifluoromethanesulfonyl)imide which is the anion-containing salt having the fluoro group and the sulfonyl group. The anion-containing salt having the fluoro group and the sulfonyl group is added to the rubber component without the intermediary of a medium which consists of a low molecular weight polyether compound whose molecular weight is not more than 10000 or a low-molecular-weight polar compound whose molecular weight is not more than 10000 and is uniformly dispersed in the rubber composition.

As the chemical foaming agent, 7.5 parts by weight of ADCA was used. As the foaming assistant, 7.5 parts by weight of urea and 1.5 parts by weight of powdered sulfur were used. As the vulcanizing accelerator, 1.5 parts by weight of dibenzothiazolyl disulfide and 0.5 parts by weight of tetramethylthiuram monosulfide were used. As the inorganic filler, 20 parts by weight of calcium carbonate was used.

The electric resistance value of the conductive roller 10" on which the shaft 2 was mounted is 108.7Ω at a low temperature and a low humidity (15° C., relative humidity: 10%), when a voltage of 1000V is applied thereto. The electric resistance value of the conductive roller 10" is $10^{8.0}$ Ω at a normal temperature and a normal humidity (23° C., relative humidity: 55%), when the voltage of 1000V is applied thereto. The electric resistance value of the conductive roller 10" is $10^{7.7}$Ω at a high temperature and a high humidity (30° C., relative humidity: 80%), when the voltage of 1000V is applied thereto.

The subtraction of the value of the common logarithm of the electric resistance value at an initial state of the application of the voltage of 1000V to the conductive roller 10" from the value of the common logarithm of the electric resistance value 96 hours after the voltage of 1000V was continuously applied thereto at the above temperature and humidity is 0.3.

The conductive foamed roller 1 has a Shore E hardness of 31 and a compression set of 16%.

The method of manufacturing the conductive foamed roller of the present invention is described in detail below.

Initially, the lithium-bis(trifluoromethanesulfonyl)imide and the EO-PO-AGE terpolymer are kneaded with a kneader at 60° C. for three minutes. The NBR whose bound acrylonitrile amount is not more than 25%, the EPDM, and other components are added to the kneaded components. Thereafter all the components are kneaded with an open roller at 60° C. for four minutes to obtain the rubber composition.

The rubber composition is supplied to a mono-axial extruder having ϕ60 mm and is extruded tubularly from the extruder to preform it. The obtained raw rubber tube is cut to a predetermined size to obtain a preform. The preform is supplied to a vulcanizing can of a pressure water vapor type. The chemical foaming agent gasifies and foams, and the rubber component is vulcanized at a rubber component-crosslinking temperature (160° C. for 15 to 70 minutes).

After a hot-melt adhesive is coated on the peripheral surface of a shaft, the shaft is inserted into the hollow portion of the obtained vulcanized rubber tube. After the shaft and the vulcanized rubber tube are heated and bonded, the surface of the vulcanized rubber tube is polished.

The conductive elastic layer 1" contains a mixture of acrylonitrile butadiene rubber (NBR) whose bound acrylonitrile amount is not more than 25%, the ethylene-propylene-diene terpolymer(EPDM), and the polyethylene oxide(EO)-polypropylene oxide(PO)-allyl glycidyl ether(AGE) terpolymer; and the anion-containing salt having the fluoro group and the sulfonyl group added thereto in a specified weight ratio. The rubber composition is foamed by the chemical foaming agent. Therefore the conductive foamed roller has superior flexibility, a low electric resistance value, and reduces the rise of the electric resistance during successive energization and the degree of dependence of the electric resistance value on environment. Thus the conductive foamed roller can be used suitably as rollers such as the transfer roller for use in the image-forming apparatus.

Similarly to the first embodiment, it is possible to apply the conductive roller 10" to the color printer, shown in FIG. 2, having the intermediate transfer belt 13.

Examples 18 through 21 of the conductive roller of the present invention and comparison example 8 will be described in detail below.

Using components shown in table 4, the conductive roller of the examples and the comparison example was prepared by using a method similar to that of the first embodiment.

As the anion-containing salt (conductive organic metal salt shown in table) having the fluoro group and the sulfonyl group, lithium-bis(trifluoromethanesulfonyl)imide was used. In the EO-PO-AGE terpolymer, the polyethylene oxide (PO), the polypropylene oxide (EO), and the allyl glycidyl ether terpolymer (AGE) were copolymerized at 90:4:6. The number-average molecular weight Mn of the PO-EO-AGE terpolymer was set to 80000. As the vulcanizing accelerator, Knockseller-DM (dibenzothiazolyl sulfide) and Knockseller-TS (tetramethylthiuram monosulfide) were used.

The conductive roller has an inner diameter of 6 mm, an outer diameter of 15 mm, and a length of 230 mm. The shaft was made of SUM22 L.

TABLE 4

| Components | Trade name | Maker | E18 | E19 | E20 | E21 | CE8 |
|---|---|---|---|---|---|---|---|
| NBR | DN401LL(AL18%) | Nippon Zeon | 80 | 70 | 50 | 50 | 70 |
| NBR | DN300(AL28%) | Nippon Zeon | | | | | |
| EPDM | EPT4045 | Mitsui Kagaku | 15 | 20 | 30 | 20 | 20 |
| PEO + PPO + AGE terpolymer | ZSN8030 | Nippon Zeon | 5 | 10 | 20 | 30 | 10 |
| Conductive organic metal salt | | | 1 | 1 | 1 | 1 | — |
| Inorganic filler | Soft calcium carbonate | Maruo Calcium | 20 | 20 | 20 | 20 | 20 |
| Foaming agent (ADCA) | Vinyhall AC#3 | Eiwa Kasei | 7.5 | 7.5 | 7.5 | 7.5 | 7.5 |
| Foaming assistant (urea) | Cell paste 101 | Eiwa Kasei | 7.5 | 7.5 | 7.5 | 7.5 | 7.5 |
| Vulcanizing agent | Sulfur | Tsurumi Kagaku | 1.5 | 1.5 | 1.5 | 1.5 | 1.5 |
| Vulcanizing accelerator | DM | Ouchi Shinko Kagaku | 1.5 | 1.5 | 1.5 | 1.5 | 1.5 |
| Vulcanizing accelerator | TS | Ouchi Shinko Kagaku | 0.5 | 0.5 | 0.5 | 0.5 | 0.5 |
| Electric resistance | | | | | | | |
| ① 15° C. 10% | 1000 V | | 8.7 | 8.4 | 8.2 | 7.8 | 8.8 |
| ② 23° C. 55% | 1000 V | | 8.0 | 7.7 | 7.5 | 7.1 | 7.8 |
| ③ 30° C. 80% | 1000 V | | 7.7 | 7.4 | 7.1 | 6.6 | 7.2 |
| Fluctuation in dependence on environment | ① –③ | | 1.0 | 1.0 | 1.1 | 1.2 | 1.6 |

TABLE 4-continued

| Components | Trade name | Maker | E18 | E19 | E20 | E21 | CE8 |
|---|---|---|---|---|---|---|---|
| Rise of electric resistance during energization | 1000 V × 96 hours | | 0.3 | 0.3 | 0.3 | 0.3 | 0.5 |
| Hardness | Shore E, 500 g | | 31 | 33 | 37 | 39 | 33 |
| Compression set | 70° C. 22 hr 25% | | 16 | 17 | 18 | 19 | 17 |
| Stain of photosensitive member | 40° C. 90% 2 weeks | | ○ | ○ | ○ | ○ | ○ |
| Judgement | | | ○ | ○ | ○ | ○ | X |

where E denotes example and where CE denotes comparison example.

EXAMPLES 18 THROUGH 21

Each rubber composition contained a mixture of the NBR whose bound acrylonitrile amount was 18%, the EPDM, and the EO-PO-AGE terpolymer mixed with one another at a predetermined specified weight ratio. The anion-containing salt having the fluoro group and the sulfonyl group was dispersed at a specified weight ratio in the rubber component. The polymer composition was foamed with a chemical foaming agent to obtain the conductive foamed roller of each of the examples 18 through 21.

COMPARISON EXAMPLE 8

NBR whose bound acrylonitrile amount was 18%, EPDM, and EO-PO-AGE terpolymer were used, but the anion-containing salt having the fluoro group and the sulfonyl group was not used.

The electric resistance value, hardness, and compression set of the conductive roller of each of the examples and the comparison examples were measured. Whether the rollers stained the photosensitive member was evaluated by the above-described method. Regarding fluctuation of the electric resistance value in dependence on environment, the rise of the electric resistance, and judgement, the following evaluations were made by using a method which will be described later.

Fluctuation in Dependence on Environment

The fluctuation in dependence on environment was evaluated by the value obtained by subtracting the value of the common logarithm of the electric resistance value of the conductive roller at high temperature and humidity (30° C., relative humidity: 80%) from the value of the common logarithm of the electric resistance value thereof at low temperature and humidity (15° C., relative humidity: 10%). The value of fluctuation in dependence on environment is favorably less than 1.5. The smaller, the better.

Rise of Electric Resistance

The rise of the electric resistance (rise of electric resistance during energization) of the conductive roller was evaluated by the value obtained by subtracting the value of the common logarithm of the electric resistance value at an initial state of continuous application of a voltage of 1000V to the conductive roller from the value of the common logarithm of the electric resistance value 96 hours after the voltage of 1000V was continuously applied thereto at the low temperature and humidity (15° C., relative humidity: 10%). The rise of the electric resistance is favorably less than 0.5. The smaller, the better.

Judgement

Based on the results of the measurement and the tests, conductive rollers which satisfied demanded performances and judged that they were excellent as conductive foamed rollers for an image-forming apparatus were marked by O, whereas those judged that they were inferior were marked by X.

As shown in table 4, the conductive roller of each of the examples 18 through 21 showed a favorable electric resistance value in the above-described conditions. Thus the conductive roller can be used favorably as the transfer roller. Each conductive roller had a small value less than 1.5 in the fluctuation of the electric resistance in dependence on environment value. Each conductive roller had a small value less than 0.5 in its value of the rise of electric resistance during energization. Thus it was confirmed that the conductive roller of each of the examples 18 through 21 was excellent in the electrical characteristics thereof. Further each conductive roller had a low hardness and a proper degree of flexibility as the transfer roller. Furthermore each conductive roller had a small compression set, was superior in its dimensional stability, and did not stain the photosensitive member.

The conductive foamed roller of the comparison example 8 did not contain the anion-containing salt having the fluoro group and the sulfonyl group. Therefore the conductive foamed roller had a large value, namely, 1.5 in the fluctuation in dependence on environment, and had a large value, namely, 0.5 in the rise of electric resistance during energization.

As apparent from the foregoing description, according to the present invention, it is possible to maintain a low electric resistance, reduce the degree of dependence of the electric resistance on environment, and suppress the rise of the electric resistance during successive energization. Further the conductive roller is excellent in flexibility, has a low compression set and does not stain the photosensitive member. Further since the conductive roller is ionic-conductive, there is a small variation in the electric resistance, and the electric resistance can be adjusted easily. Therefore the conductive roller can be used suitably as the transfer roller for the image-forming apparatus, thus preventing a toner image from having irregularities and providing a preferable image.

The image-forming apparatus such as the copying machine, the facsimile, the printer, and the like having the conductive foamed roller of the present invention provides a preferable image reliably and does not require a large power unit to cover the change in the electric resistance value and hence has a low power consumption. Further it is not necessary to control the voltage to be applied to the conductive roller. Thus the conductive roller allows the image-forming apparatus to have a simple construction. In addition, the conductive roller allows the control system of the image-forming apparatus to have a simple construction. Furthermore it is possible to reduce the number of environment tests that are made for development. Therefore it is possible to reduce the period of time and the cost required for development.

What is claimed is:

1. A conductive roller comprising at least one conductive elastic layer, said conductive elastic layer formed of a polymer composition comprising:

a main-component polymer not containing chlorine nor bromine and containing polyether or/and a cyano group;

a low polar ozone-resistant rubber; and an anion-containing salt having a fluoro group and a sulfonyl group added in an amount of not less than 01.01 parts by weight nor more than 20 parts by weight to 100 parts by weight of said polymer component and said rubber component; and a chemical foaming agent to foam said polymer composition, wherein said anion-containing salt having said fluoro group and said sulfonyl group includes at least one salt selected from among a salt of bisfluoroalkylsulfonylimide, and a salt of tris(fluoroalkylsulfonyl)methide, wherein said conductive foamed elastic layer has a compression set not more than 30%, when said compression set is measured at a temperature of 70° C. for 24 hours at a compressibility ratio of 25% in accordance with the method of testing permanent strain of vulcanized rubber and thermoplastic rubber specified in JIS K6262, and wherein said conductive foamed elastic layer has a Shore E hardness measured by a durometer of type E of not less than 20 nor more than 40 in accordance with the method of testing hardness of vulcanized rubber and thermoplastic rubber specified in JIS K6253.

2. The conductive roller according to claim 1, wherein said polymer containing said polyether or/and said cyano group is contained in said polymer composition at not less than 20 wt % nor more than 90 wt % of the entire polymer component of said polymer composition.

3. The conductive roller according to claim 2, wherein as said polymer having said cyano group is one or more polymers selected from the group consisting of acrylonitrile butadiene rubber (NBR), hydrogenated acrylonitrile butadiene rubber, carboxyl-modified acrylonitrile butadiene rubber, acrylonitrile butadiene isoprene terpolymer (NBIR), and liquid nitrile rubber; and said low polar ozone-resistant rubber is one or more rubbers selected from the group consisting of ethylene propylene rubber (EPM), ethylene-propylene-diene terpolymer (EPDM), styrene-butadiene copolymer rubber (SBR), butyl rubber (IIR), and silicone rubber (Q).

4. The conductive roller according to claim 1, wherein EPDM is used as said low polar ozone-resistant rubber; and said EPDM is contained in an amount of 10 wt % to 80 wt % of the entire polymer component of said polymer composition.

5. The conductive roller according to claim 1, containing carbon black as a filler.

6. The conductive roller according to claim 1, wherein an electric resistance value of said conductive roller measured by applying a voltage of 1000V thereto at a temperature of 23° C. and a relative humidity of 55% is set to not less than $10^4\Omega$ nor more than $10^9\Omega$;

when said voltage of 1000V is applied to said conductive roller, a ratio of a maximum value of an electric resistance of said conductive roller in a circumferential direction thereof to a minimum value of said electric resistance thereof in said circumferential direction is set to not more than 1.3;

when an electric resistance value R(Ω) of said conductive roller is measured at a temperature of 10° C. and a relative humidity of 15% and at a temperature of 32.5° C. and a relative humidity of 90% by applying said voltage of 1000V thereto, a value of an equation of $\Delta \log_{10}R=\log_{10}R$ (electric resistance value at temperature of 10° C. and relative humidity of 15%)$-\log_{10}R$(electric resistance value at temperature of 32.5° C. and relative humidity of 90%) is set to not more than 1.4; and a difference between a common logarithm of an electric resistance value of said conductive roller measured by applying a voltage of 100V thereto at a temperature of 23° C. and a relative humidity of 55% and a common logarithm of an electric resistance value measured by applying a voltage of 5000V thereto at a temperature of 23° C. and a relative humidity of 55% is set to not more than 0.5.

7. The conductive roller according to claim 1, wherein a ratio of an electric resistance value of said conductive roller six seconds after a constant voltage of 1000V is applied thereto to an electric resistance value thereof at a time when said constant voltage of 1000V is applied thereto at a temperature of 110° C. and a relative humidity of 15% is set to not less than 100% nor more than 105%.

8. The conductive roller according to claim 1, wherein said conductive elastic layer has a compression set not more than 35%, when said compression set is measured at a temperature of 70° C. for 24 hours at a compressibility ratio of 25% in accordance with the method of testing permanent strain of vulcanized rubber and thermoplastic rubber specified in JIS K6262; and said conductive elastic layer has a hardness not more than 70 degrees, when said hardness is measured by a durometer of type E specified in JIS K6253.

9. The conductive roller according to claim 1, wherein said low polar ozone-resistant rubber is ethylene-propylene-diene terpolymer (EPDM) and said main-component polymer is acrylonitrile butadiene rubber (NBR).

10. The conductive roller according to claim 9, wherein a weight ratio between said ethylene-propylene-diene terpolymer and said acrylonitrile butadiene rubber is 75:25 to 20:80.

11. The conductive roller according to claim 9, wherein said chemical foaming agent is azodicarbonamide (ADCA) and/or 4,4'-oxybis (benzene sulfonyl hydrazide) (OBSH);

not less than three parts by weight nor more than 12 parts by weight of said chemical foaming agent is added to 100 parts by weight of said rubber component; and urea is used as a foaming assistant; and not less than three parts by weight nor more than 12 parts by weight of said foaming assistant is added to 100 parts by weight of said rubber component.

12. The conductive roller according to claim 1, wherein said polymer composition comprises a mixture of acrylonitrile butadiene rubber (NBR) having a bound acrylonitrile amount at not more than 25%, ethylene-propylene-diene terpolymer (EPDM), and polyethylene oxide-polypropylene oxide-allyl glycidyl ether terpolymer (PO-EO-AGE terpolymer) to foam said mixture.

13. A conductive roller according to claim 12, wherein said NBR, said EPDM, and said PO-EO-AGE copolymer are mixed with one another at not less than 50 parts by weight nor more than 80 parts by weight, at not less than 0.5 parts by weight nor more than 30 parts by weight, and at not less than 0.5 parts by weight nor more than 30 parts by weight respectively for 100 parts by weight of said mixture; and not less than 0.5 parts by weight nor more than two parts by weight of said anion-containing salt having said fluoro group and said sulfonyl group is added to 100 parts by weight of said mixture.

14. An image-forming apparatus having a conductive roller according to claim 1.

* * * * *

UNITED STATES PATENT AND TRADEMARK OFFICE

CERTIFICATE OF CORRECTION

PATENT NO. : 7,172,544 B2
APPLICATION NO. : 10/705950
DATED : February 6, 2007
INVENTOR(S) : Yogun Ki et al.

It is certified that error appears in the above-identified patent and that said Letters Patent is hereby corrected as shown below:

Claim 1, column 41, line 15, change "01.01 parts by weight" to correctly read --0.01 parts by weight...--.

Signed and Sealed this

Thirteenth Day of November, 2007

JON W. DUDAS
*Director of the United States Patent and Trademark Office*